US007534200B1

(12) United States Patent
Martinez

(10) Patent No.: US 7,534,200 B1
(45) **Date of Patent: *May 19, 2009**

(54) APPARATUS FOR BACK THERAPY AND MULTIPLE EXERCISES

(76) Inventor: Ramond Randy Martinez, 3730 Providence La., Pasadena, TX (US) 77505

( * ) Notice: Subject to any disclaimer, the term of this patent is extended or adjusted under 35 U.S.C. 154(b) by 0 days.

This patent is subject to a terminal disclaimer.

(21) Appl. No.: 11/520,073

(22) Filed: Sep. 12, 2006

Related U.S. Application Data

(63) Continuation-in-part of application No. 10/846,193, filed on May 13, 2004, now Pat. No. 7,104,939.

(60) Provisional application No. 60/470,169, filed on May 13, 2003.

(51) Int. Cl.
*A63B 26/00* (2006.01)

(52) U.S. Cl. ..... 482/142; 482/35

(58) Field of Classification Search ..... 482/142, 482/140, 143–145; D21/676, 686, 690
See application file for complete search history.

*Primary Examiner*—Lori Amerson

(74) *Attorney, Agent, or Firm*—Kenneth A. Roddy

(57) ABSTRACT

A freestanding back therapy and multiple exercise station on which various therapeutic, stretching, bending, twisting, extension and inversion exercises may be carried out utilizing the user's weight for fully flexing and decompressing the spine and strengthening the trunk and back muscles of the user. The station has a frame of tubular construction with a floor engaging base, front and rear vertical upright members, a horizontal top member extending between upper ends thereof, and a cushioned forearm pad on each said horizontal member with handgrips at outer of the horizontal top members. A lower pair of vertically spaced padded cross members extend transversely between the rear vertical upright members to serve as foot supports. A central upright member is connected at a lower end with at least one padded cross member and has a forward and angularly upward extending upper portion. A backrest pad is mounted the central upright member. An upper pair of parallel vertically spaced padded tubular members extend laterally outward from each side of the central upright member near its upper portion to selectively serve either as handgrips or as elevated or leg or foot supports when performing exercises. A removable rotatable cylindrical cushioned roller is may be mounted transversely between the horizontal top members to serve as a back engaging roller or a seating surface when performing exercises. Various auxiliary exercise apparatus may be removably connected with the station for performing a variety of exercises.

21 Claims, 17 Drawing Sheets

APPARATUS FOR BACK THERAPY AND MULTIPLE EXERCISES

CROSS REFERENCE TO RELATED APPLICATION

This application is a Continuation-In-Part and claims priority from U.S. patent application Ser. No. 10/846,193, filed May 13, 2004 now U.S. Pat. No. 7,104,939, which claimed priority from U.S. Provisional application Ser. No. 60/470,169, filed May 13, 2003. The entireties of the prior applications are incorporated herein by reference.

BACKGROUND OF THE INVENTION

1. Field of the Invention

This invention relates generally to exercise and back therapy apparatus, and more particularly to a back therapy and exercise station on which performance of various multiple therapeutic, stretching, bending, twisting and inversion exercises may be carried out for flexing and decompressing the spine and strengthening the muscles of the body of the user.

2. Background Art

The human spine or vertebral column is a complex structure which is designed to support loads, protect the spinal cord, and attenuate the forces that are commonly transferred to and from the trunk and arms to the lower extremities. The vertebral column is made up of 24 true vertebrae, seven cervical, twelve thoracic, and five lumbar. There are five sacral vertebrae, which in the adult are fused together, thereby not representing true vertebrae. There are three major curves associated with the vertebral column that are functional in the support of the body. The lumbar and cervical curves are convex anteriorly, whereas the thoracic curve is convex posteriorly. There are normal deviations from vertical in the coronal plane as well.

Each vertebra is separated from adjacent vertebrae by intervertebral discs, which function as shock absorbers between the vertebral bodies and maintain the space between the vertebrae open sufficient to insure that the nerves and the blood vessels can pass between them without injury. There are two major components of discs, a viscous inner portion called the nucleus pulposis and a tough fibrous tissue surrounding the nucleus called the annulus fibrosis. Due to the forces that the vertebral column commonly experiences, the annulus will sometimes become herniated allowing the nucleus to seep out of confinement. The flow of the nucleus out of the annulus will often impinge upon spinal nerves causing clinical problems ranging from pain to quasiparalysis. This is commonly referred to as a "slipped disc."

The individual vertebrae and intervertebral discs are stabilized by vertebral ligaments. The posterior ligaments are those which tend to resist the vertebral column's tendency to flex, and the anterior ligaments are those which help prevent extension. The ligaments are strong and somewhat inelastic.

The musculature of the vertebral column is also extensive and complex. The anterior vertebral muscles are those which tend to cause vertebral flexion and include the abdominal muscles (rectus abdominus, the external obliques, and the internal obliques). The psoas major and minor muscles have attachments to the anterior aspect of the vertebral column in the lumbar region, and have a tendency to cause extension of the lumbar vertebrae. The primary extensors are those muscles which are classified as posterior vertebral muscles. A simplification of the muscles places them in a single group of muscles called the erector spinae.

The loads on the vertebral column come from three sources: body weight, external forces, and internal forces. Any particular vertebrae will be affected by the weight of any body mass that is superior to its location. External forces comprise any force, or weight, that is added to the vertebral column. Internal forces represent forces that are created by muscles and ligaments. The erector spinae, for example, which are found bilaterally just lateral to the vertebral column, cause the vertebral column to undergo compressive forces when they contract.

There are three basic types of forces that affect the vertebral column. In general, these are compression, shear, and torsion forces. Compression forces act predominately upon the intervertebral discs. Shear forces, however, have their predominant effect at the intervertebral foramen, the site at which spinal nerves exit from the vertebral column. Torsion forces are twisting forces and may affect both of these structures.

Tension is a force quite common in the vertebral column. During flexion of the trunk, for example, the anterior aspect of the intervertebral body undergoes compression as a result of the adjacent vertebral bodies moving closer to one another. The posterior aspect of the intervertebral disc, however, undergoes tension, as do the posterior vertebral ligaments which serve to restrict the degree of flexion which may occur.

Without proper muscular support the vertebrae become unstable, and if the discs flatten out or become damaged, decreased circulation an/or nerve function can result. The discs also flatten over a period of time as one ages principally due to the weight of the head, neck and shoulders, and gravitational stress constantly compressing the spine. Weak abdominal muscles, poor posture and lack of exercise all contribute to further weaken the muscular support for the vertebrae and can make a person more susceptible to back sprains or more serious injury. Painful and disabling low back disorders are caused by disc herniations (subligamentous and extruded), degenerative disc disease, sciatica and posterior facet arthrosis.

Freestanding exercise machines known as "Vertical Knee Raise" (VKR) stations are known in the art which utilize the weight of the user's body, without stressing the back, in performing various exercises such as knee raises, leg raises and oblique twists and bends, which, tighten the user's midsection and provide stretching and contraction of the back muscles to some extent. These types of freestanding stations also allow the user to perform chinning and pull-up exercises, which strengthen the muscles of the arms and upper torso.

Freestanding exercise machines known as "imversion machines" are known in the art, which utilize the weight of the user's body to decompress the spine via controlled traction in the cervical and/or lumbar spine areas. These types of devices effect decompression by suspending the body from the heels in an up-side-down manner, or suspend the body above a support surface by the thighs, pelvis or abdomen. Although some limited amount of exercise may be performed in an inverted position, most of these types of devices are designed primarily for spinal decompression and are not entirely satisfactory for fully flexing the spine and strengthening the back extensor muscles and toning the abdominal muscles, and the exercises performable on such devices are merely an incident of the inverted supported position.

Tension machines are also known in that art for the treatment of painful and disabling low back disorders caused by disc herniations (subligamentous and extruded), degenerative disc disease, sciatica and posterior facet arthrosis. These types of machines apply controlled tension along the axis of the spinal column to distract the vertebral segments and posterior facets of the lumbar spine and decompress the intervertebral discs. Some of these machines create a vacuum effect within the disc drawing the herniation back into place and drawing fluids back into the disc so they can heal. Although such treatment effectively reduces pain and improves the mobility of the back in a significant number of patients, these types of tensioning machines are designed specifically for spinal decompression and do not provide means for exercising and strengthening the back extensor muscles and toning the abdominal muscles.

The present invention is distinguished over the prior art in general by a freestanding back therapy and multiple exercise station on which on performance of various therapeutic, stretching, bending, twisting, extension and inversion exercises may be carried out for fully flexing and decompressing the spine and strengthening the trunk and back muscles of the user. The station has a frame of tubular construction with a floor engaging base, front and rear vertical upright members, a horizontal top member extending between upper ends thereof, and a cushioned forearm pad on each said horizontal member with handgrips at outer of the horizontal top members. A lower pair of vertically spaced padded cross members extend transversely between the rear vertical upright members to serve as foot supports. A central upright member is connected at a lower end with at least one padded cross member and has a forward and angularly upward extending upper portion. A backrest pad is mounted the central upright member. An upper pair of parallel vertically spaced padded tubular members extend laterally outward from each side of the central upright member near its upper portion to selectively serve either as handgrips or as elevated or leg or foot supports when performing exercises. A cushioned roller may be rotatably mounted at selected heights on the frame for performing a variety of exercises. Various exercise apparatus may be connected with the station for performing a wide variety of exercises.

SUMMARY OF THE INVENTION

It is therefore an object of the present invention to provide a freestanding back therapy and exercise station on which on performance of various therapeutic, stretching, bending, twisting, extension and inversion exercises may be carried out utilizing the user's weight for fully flexing and decompressing the spine and strengthening the trunk, legs, arms, body and back muscles of the user.

It is another object of this invention to provide a freestanding back therapy and exercise station constructed of tubular members that is easily and quickly assembled without special tools and can be stored and shipped in a compact package in a disassembled condition.

Another object of this invention is to provide a freestanding back therapy and exercise station having a stable support frame capable of safely suspending a user's body above a ground-support surface in various cantilevered and inverted positions and withstanding the torque exerted by rigorous exercise on the device.

Another object of this invention is to provide a freestanding back therapy and exercise station that will significantly reduce back pain and discomfort, as well as make flexible the user's body.

Another object of this invention is to provide a freestanding back therapy and exercise station having a frame on which various auxiliary exercise apparatus may be removably connected with the station for performing a variety of exercises.

A further object of this invention is to provide a freestanding back therapy and exercise station that will enhance blood flow and increase delivery of oxygen nutrition and enzymes to the spinal column areas and other parts of the user's body.

A still further object of this invention is to provide a freestanding back therapy and exercise station that is simple in construction and inexpensive to manufacture.

Other objects of the invention will become apparent from time to time throughout the specification and claims as hereinafter related.

The above noted objects and other objects of the invention are accomplished by the present freestanding back therapy and multiple exercise station on which on performance of various therapeutic, stretching, bending, twisting, extension and inversion exercises may be carried out for fully flexing and decompressing the spine and strengthening the trunk and back muscles of the user. The station has a frame of tubular construction with a floor engaging base, front and rear vertical upright members, a horizontal top member extending between upper ends thereof, and a cushioned forearm pad on each said horizontal member with handgrips at outer of the horizontal top members. A lower pair of vertically spaced padded cross members extend transversely between the rear vertical upright members to serve as foot supports. A central upright member is connected at a lower end with at least one padded cross member and has a forward and angularly upward extending upper portion. A backrest pad is mounted the central upright member. An upper pair of parallel vertically spaced padded tubular members extend laterally outward from each side of the central upright member near its upper portion to selectively serve either as handgrips or as elevated or leg or foot supports when performing exercises. A cylindrical cushioned roller may be mounted at selected levels on the frame to serve as a back, legs, body engaging roller or a seating surface when performing exercises. Various auxiliary exercise apparatus may be connected to the frame for performing a wide variety of exercises.

DESCRIPTION OF THE PREFERRED EMBODIMENTS

Figure 1:
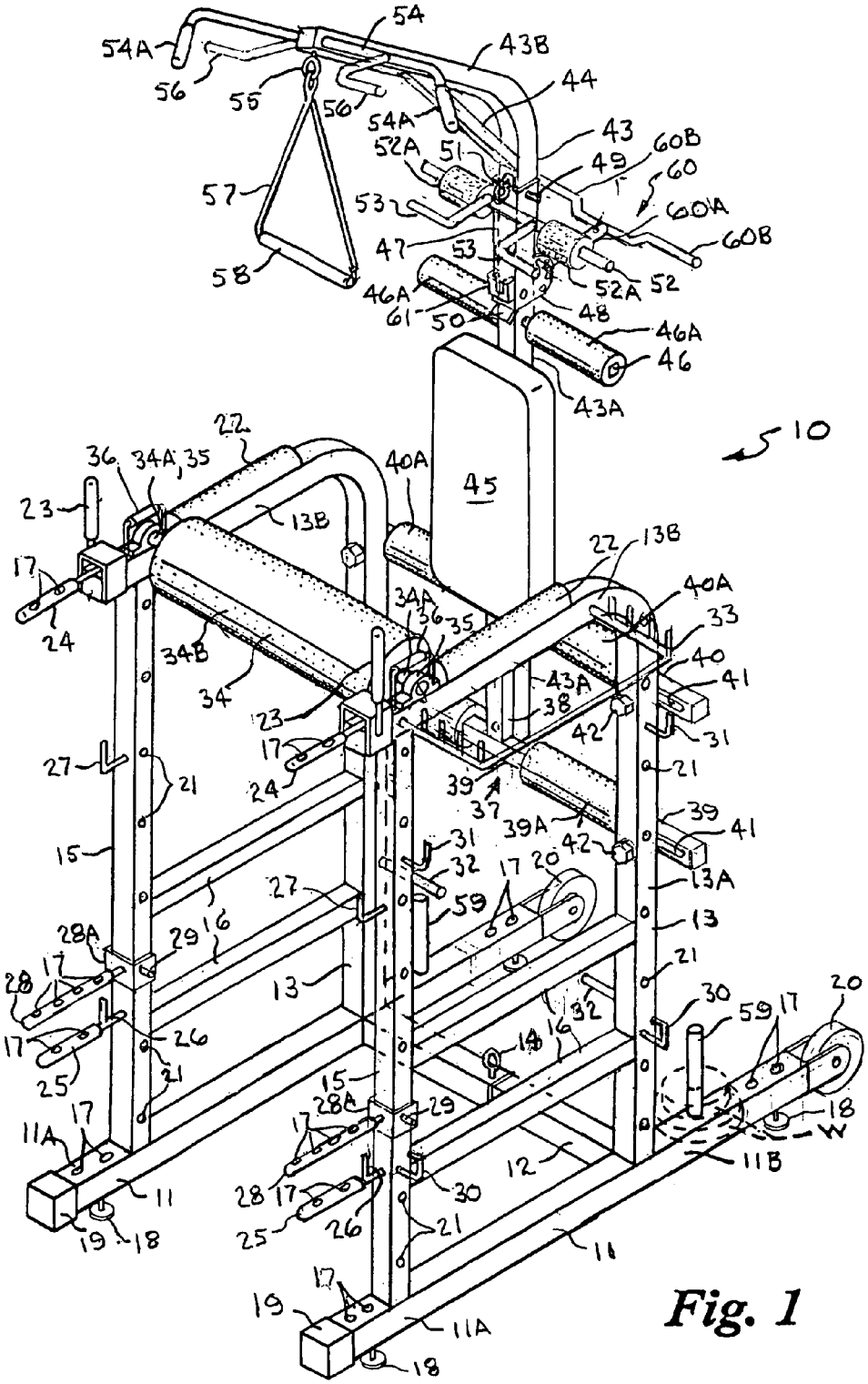
FIG. 1 is an isometric view of the back therapy and multiple exercise station in accordance with a preferred embodiment of the present invention and some of its accessories.

Referring to the drawings by numerals of reference, there is shown in FIG. 1, a preferred a back therapy and multiple exercise apparatus or station 10. The principle structural frame members of the station 10 are preferably constructed of square or rectangular cross section steel tubing, as is common practice for exercise equipment. The individual members may be joined by welding or releasably connected by mechanical fasteners as appropriate to facilitate assembly and disassembly, and compact storage and shipping.

The station 10 is supported on the floor by a pair of elongate tubular base members 11, disposed in parallel laterally spaced relation having a transverse telescoping tubular base cross member 12 extending therebetween, near their rearward ends. A pair of tubular lateral rear upright members 13, having a generally inverted L-shaped configuration, are each connected at their bottom end to a respective base member 11. Each lateral rear upright member 13 has a longer vertical leg 13A and a shorter horizontal leg 13B that extends forward therefrom over the respective base member 11 in vertically spaced parallel relation. An eyebolt 14 or ring may be secured to the transverse base cross member 12 for connecting elastic bands or bungee cords having handles for receiving the hands or feet of a user to perform various arm, chest and leg exercises.

A pair of tubular lateral front upright members 15 are each connected at their bottom end to a respective base member 11 near its forward end and at their top end to the underside of a respective horizontal leg 13B of the rear upright members 13 to extend vertically therebetween in parallel relation. Although, the shorter horizontal legs 13B are shown as integrally formed with the rear upright member 13, alternatively, the shorter horizontal legs 13B may be separate members removably connected between the top ends of the front upright members 15 and the vertical leg 13A of the rear upright members 13. A pair of upper and lower tubular horizontal cross members 16 are connected at their outer ends to the front upright members 15 and the vertical leg 13A of the rear upright members 13 at each side of the station 10.

The base members 11 have a front portion 11A that extends forwardly from the front upright members 15 and a rear portion 11B that extends rearwardly from the vertical leg 13A of the rear upright members 13. The top of the front and rear portions 11A and 11B of the base members 11 are provided with mounting holes 17 for mounting various components (described hereinafter), and may be provided with leveling pads 18 on their underside, end caps 19 at their front ends, and wheels 20 at their back ends. The lateral sides of the front upright members 15 and the vertical leg 13A of the rear upright members 13 are provided with a plurality of mounting holes 21 for mounting various components (described hereinafter).

A cushioned forearm pad 22 is mounted on the top surface of the horizontal leg 13B of each lateral rear upright member 13. An upper dual grip member having a vertical handgrip 23 and a horizontal handgrip 24 is connected to the front end of the horizontal leg 13B of each lateral upright member 13. The upper dual grip member may be removably connected to the front end of the horizontal leg 13B by a latch pin or other suitable fastener. A lower horizontal handgrip 25 is connected to the front side of each front upright member 15 near its lower end and each has a vertical rod portion spaced a short distance from the front side to form a generally U-shaped lower support surface 26. A pair of generally L-shaped rod members 27 are connected to the front side of each front upright member 15 near their upper ends to form a pair of generally U-shaped upper support surfaces.

A pair of relatively longer, vertically adjustable horizontal handgrips 28, each having a U-shaped bracket 28A at one end is mounted on a respective front upright member 15. The lateral sides of the brackets 28A are provided with holes that align with the holes 21 on the lateral sides of the front upright members 15, whereby the handgrips 28 can be mounted at selected heights on the front upright members 15, or may be mounted on the vertical legs 13A of the rear upright members 13, by installing a latch pin 29 therethrough.

The outwardly extending portions of the upper horizontal handgrips 24, lower horizontal handgrips 25, and vertically adjustable horizontal handgrips 28, are provided with mounting holes 17 for mounting various components (described hereinafter).

A generally J-shaped rod member 30 is connected to the outer side of each front and rear upright member 15 and 13 near their lower ends in laterally opposed relation to form a generally J-shaped hook or lower support surface on the side of the station 10. A generally L-shaped rod member 31 is connected to the outer side of each front and rear upright member 15 and 13 a distance above each lower J-shaped member 30 in laterally opposed relation with its vertical portion spaced a short distance from the outer side to form a generally U-shaped upper support surface on the side of the station 10.

The lower and upper U-shaped and J-shaped support surfaces described above are used for connecting additional exercise apparatus to the station 10, as described hereinafter.

A horizontal foot support rod 32 is mounted on the inner facing side of the vertical leg 13A of each rear upright member 13 in laterally opposed relation for use as steps in mounting the station and/or hooking the user's feet in performing various exercises.

A utility storage rack 33 is mounted on the outer facing side of at least one horizontal leg 13B of the rear upright member 13 and extends outwardly therefrom for receiving and storing various components or attachments when they are not in use.

A cylindrical roller 34 is provided which can be removably and rotatably mounted at various selected locations on the station 10. The cylindrical roller 34 is constructed of a thick pad formed of resilient cushioning material that encircles a tubular bar 34A of circular cross section. The outer ends of the bar 34A are rotatably journalled in pillow blocks 35 or other conventional rotatable fasteners provided with depending mounting pins that are received in holes in the frame members of the station 10 for quick installation and removal. The pillow blocks 35 or fasteners may be provided with protector handles 36 for lifting and transporting the roller 34 and covering the pillow blocks or fasteners when the roller is installed. The exterior of the pad of the cylindrical cushioned roller 34 may be provided with a removable or replaceable cover 34B that may have a smooth or textured surface or a surface containing resilient protrusions to provide stimulating therapeutic action while performing exercises. The interior of the cylindrical cushioned roller 34 may also contain one or more vibrating devices, which are conventional and therefore not shown, to provide additional therapeutic massaging action.

In FIG. 1, the roller 34 is shown mounted on the top surface of the horizontal legs 13B of the upright members 13 forward of the forearm pad 22 to extend transversely therebetween. Alternatively, the cylindrical roller 34 may be mounted at the forward or rearward end of the station by installing the mounting pins in the holes 17 in front or rear portions 11A or 11B of the base members 11. The cylindrical roller 34 may also be mounted at the forward end of the station 10 at various selected levels or heights by installing the mounting pins in the holes 17 in the outwardly extending portions of the upper horizontal handgrips 24, lower horizontal handgrips 25, or vertically adjustable horizontal handgrips 28, for performing various exercises (described hereinafter).

A generally I-shaped frame 37 connects the vertical legs 13A of the lateral upright members 13 in parallel laterally spaced relation. The generally I-shaped frame 37 has a vertical tubular member 38 connected between a transverse lower tubular member 39 and a transverse upper tubular member 40. The outer ends of the lower and upper tubular members 39 and 40 are provided with slots 41 and are connected to the back side of the vertical legs 13A, by bolts 42 or other fasteners extending through the slots and holes in the vertical legs 13A. The slots 42 allow the distance or lateral spacing between the vertical legs 13A to be adjusted. Pads 39A and 40A formed of a resilient cushioning material encircle the lateral portions of the transverse members 39 and 40 between the vertical tubular member 38 and the vertical legs 13A of the upright members 13. The upper and lower pair of padded cross members 40 and 39 are spaced vertically apart a sufficient distance such that a user may engage the top portion of his or her feet beneath them on the padded surfaces to support or suspend their body when performing various exercises.

A central upright member 43, having a longer vertical leg 43A and a shorter upper leg 43B that extends angularly upward and outward therefrom, is removably connected at the lower end of its vertical leg to the vertical member 38 of the I-shaped frame 37 by bolting, latch pins, or other conventional fasteners. A brace 44 may be secured diagonally between the longer vertical leg 43A and shorter upper leg 43B of the central upright member 43. A generally rectangular backrest pad 45 formed of a resilient cushioning material is mounted on the lower portion of the central upright member 43. The central upright member 43 may be connected to the vertical member 38 such that its shorter upper leg 43B extends toward the front or toward the rear of the station 10. Although the shorter upper leg 43B of the central upright member 43 is shown as integrally formed with the longer vertical leg 43A, the central upright member may formed of separate members removably connected together. Alternatively a shortened embodiment of the central upright member 43C (shown and described hereinafter) may be used which does not have an outwardly extending upper portion.

A lower tubular member 46 is connected transversely at its mid section to the upper portion of the vertical leg 43A of the central upright member 43 above the backrest pad 45 and its outer ends extend laterally outward from each side of the vertical leg 43A. A pad 46A formed of a resilient cushioning material encircle the lateral portions of the transverse tubular member 46.

A pivot arm 47 formed of a length of generally U-shaped channel straddles the vertical leg 43A of the central upright member 43 and is pivotally connected at its lower end to the lateral sides of the vertical leg just above the lower tubular member 31 by a pivot pin, or other suitable fastener, and has an arcuate bracket 48 at its lateral sides with radially spaced adjustment holes therethrough. The upper end of the pivot arm 47 has is releasably connected to the vertical leg 43A by a conventional fastener, such as a bolt or latch pin 49. The latch pin 49 may be removed to allow the pivot arm to pivot downwardly, and installed in a selected hole in the adjustment bracket 49 to retain the pivot arm at a desired angle. A stop surface 50 is also provided at the lower end of the pivot arm 47 to engage the front side of the vertical leg 43A and control the extent of the pivotal movement. The top end of the pivot arm 47 is provided with an eyebolt 51 or ring for connecting elastic bands or bungee cords having handles, or a punching bag, to perform various exercises.

A transverse tubular member 52 is secured to the pivot arm 47 and its outer ends extend outwardly from each lateral side thereof near its top end in laterally opposed relation. Pads 52A formed of a resilient cushioning material encircle the lateral portions of the tubular member 52. L-shaped ankle supports 53 may be secured to the lateral portions of the tubular member 52 or to the lateral sides of the pivot arm 47, which have outer ends extending outwardly from each side of the pivot arm 47 in laterally opposed relation for receiving the feet of the user to perform various inversion exercises.

When the top end of the pivot arm 47 is secured to vertical leg 43A, the upper padded tubular members 31 and ankle supports 53 are disposed in vertically above the lower padded tubular members 46 to provide elevated cushioned surfaces on which a user may place the instep of his or her feet to support or suspend their body when performing various inversion exercises. When the top end of the pivot arm 47 is released, it pivots angularly outward and downward relative to the vertical leg 43A to place the upper padded tubular members 33 and ankle supports 43 toward the center of the station. The latch pin 49 may be installed in a selected hole in the adjustment bracket 48 to retain the pivot arm 47 at a desired angle. In the deployed position, the pads 52A on the transverse tubular member 52 and the ankle supports 53 can be used for inversion exercises. The outer ends of the upper padded tubular member 52 can also serve as elevated handgrips whereby the user may grip them to perform various body lifting exercises, such as pull-ups or chinning and stretching exercises, and elastic bands, bungee cords having handles, or a punching bag can be attached to the eyebolt 51 or ring for performing various exercises.

A tubular pull-up bar 54 is mounted near the outer end of the upper leg 43B of the central upright member 43 by an eyebolt fastener 55. The ends of the pull-up bar 54 extend laterally outward from each side of the upper leg 43B and terminate in downward extended ends that are covered by handgrips 54A. L-shaped ankle supports 56 may be secured to the lateral portions of the pull-up bar 54 or to the lateral sides of the upper leg 43B of the central upright member 43 with their outer ends extending outwardly from each side of the upper leg in laterally opposed relation for receiving the feet of the user to perform various inversion exercises. An elastic cord 57 is looped through a short handle bar 58 and its outer ends are secured to the eyelet of the eyebolt fastener 55 for performing various exercises. Alternatively, the elastic cord may be removed, and a punching bag suspended from the eyelet of the eyebolt fastener 55. The ends of the elastic cord 57 with the handle bar 58 may also be attached to the eyebolt 51 or ring of the pivot arm 47.

While the configuration and weight of the station frame is generally adequate to provide stability during performance of various exercises and prevent overturning, a pair relatively short vertical bars 59 are connected to the top side of the rear portions 11B of the base members 11, respectively, for receiving auxiliary weights W such as disc-shaped weights of the type that are commonly used for barbells, when desired.

Figure 1A:
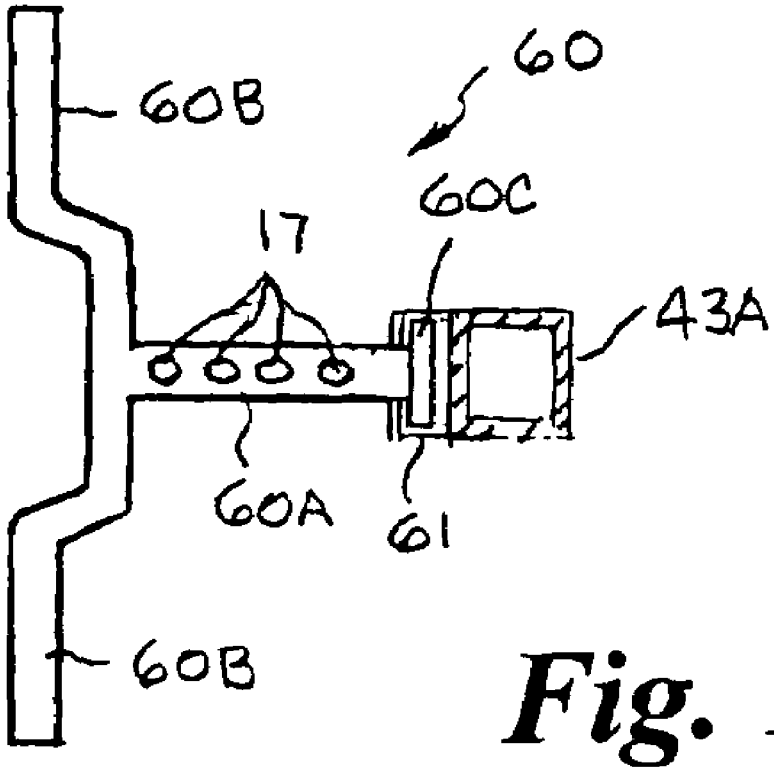
FIG. 1A is a top plan view showing a removable tubular T-shaped foot support member for connection to the exercise station for performing inversion exercises.

Referring still to FIG. 1, and additionally to FIG. 1A, a tubular T-shaped foot support member 60 may be removably attached to the back side of the vertical leg 43A, or to the front side of the pivot arm 47. The T-shaped foot support member 60 has central tubular portion 60A with a pair of laterally extending tubular members 60B at one end and a flat flange 60C at its opposed end. The back side of the vertical leg 43A and/or the front side of the pivot arm 47 are provided with slotted brackets 61 which slidably receive and retain the flange 60C of the T-shaped foot support member 60 thereon. The central tubular portion 60A of the foot support member 60 may also be provided with mounting holes 17 for mounting various components. A plurality of the brackets 61 may be provided on the back side of the vertical leg 43A for installing the T-shaped foot support 60 at various heights.

As discussed above, the rotatable cylindrical roller 34 may be installed on the station 10 at selected locations and at various levels or heights to provide a cushioned back or abdomen engaging surface, a seating surface, or for receiving the legs of a user of the apparatus to carry out various therapeutic back exercises such as stretching, bending, twisting, extension and inversion exercises utilizing the user's weight for fully flexing and decompressing the spine and strengthening the trunk and back muscles of the user.

Figure 2:
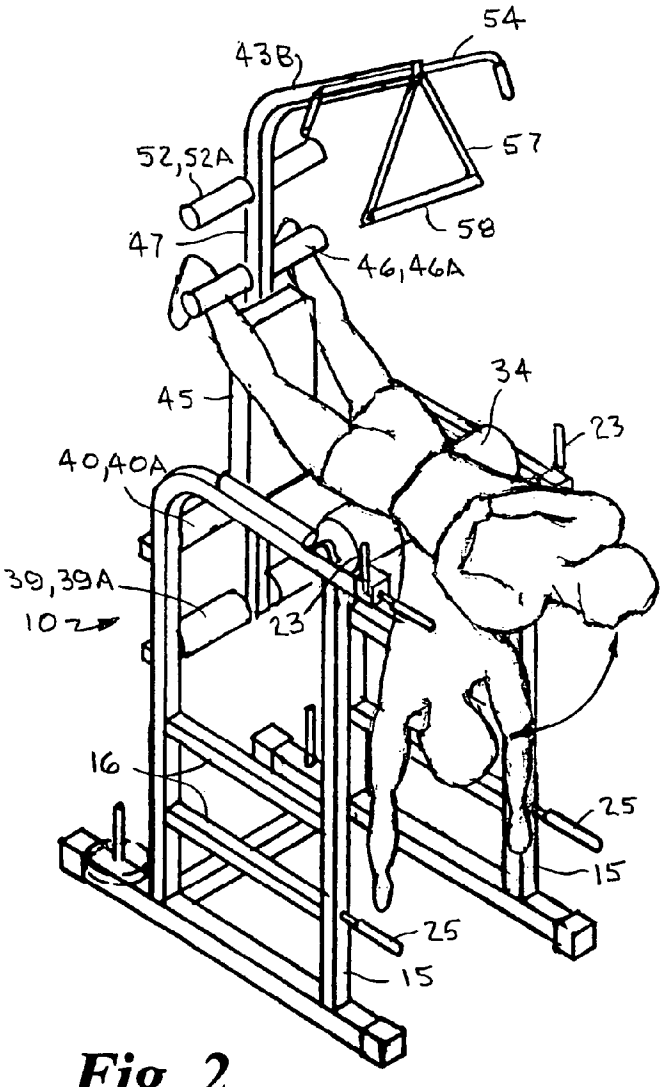
FIG. 2 is a perspective view showing, somewhat schematically, a user performing an exercise utilizing the roller installed on the horizontal top members of the exercise station.

As shown somewhat schematically in FIG. 2, when the roller 34 is installed on the horizontal legs 13B, the user can stand on the upper or lower cross members 16 facing the roller and with their abdomen engaged on the roller, lean over the roller with while gripping the vertical handgrips 23, contract their legs with their full body weight supported on the roller, and then engage the heels of their feet on the padded lower or upper tubular members 46 or 52 such that their body will be in an upside down or inverted position with their head below their feet and can grab the lower horizontal handgrips 25 for a body traction stretch. The user can also raise and lower their upper body between the inverted position and a horizontal position and perform several repetitions to flex and strengthen the back and abdominal muscles.

Figure 3:
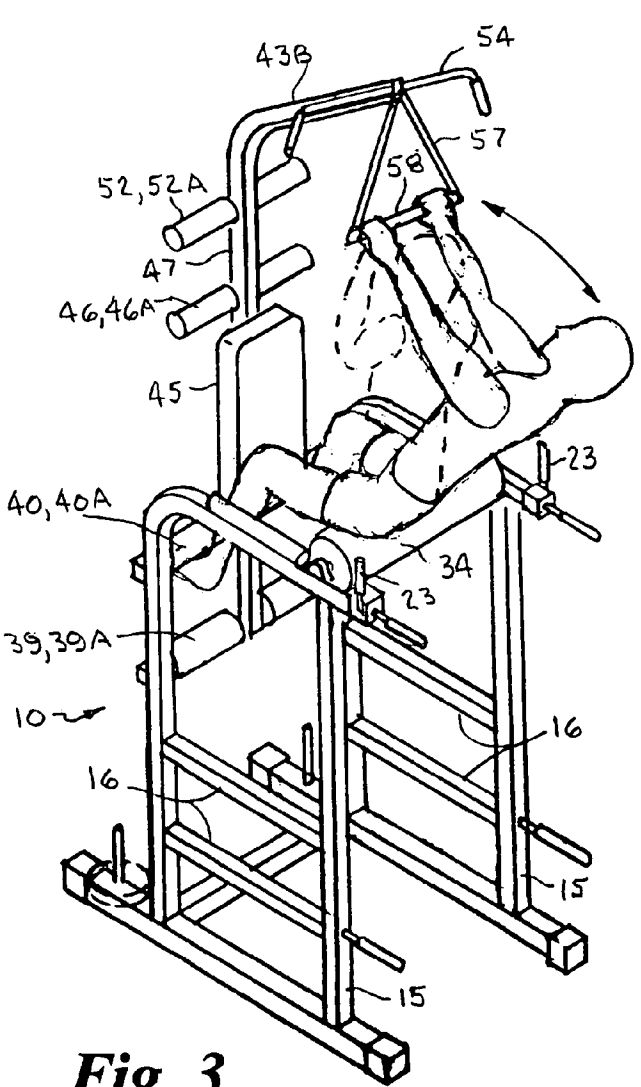
FIG. 3 is a perspective view showing, somewhat schematically, a user performing an exercise facing the rear of the machine and utilizing the roller installed on the horizontal top members of the exercise station.

As shown in FIG. 3, this exercise can also be repeated with the user facing the reverse direction. The user can sit on the roller 34 facing the rear of the station and engage the insteps of their feet on an upper or lower transverse padded tubular member 40 or 39 of the I-shaped frame 37 and lean backwards over the roller while holding the handle bar 38 of the elastic cord 37, such that their body will be in an upside down or inverted position with their head below their feet. The user can also raise and lower their upper body between the inverted position and a horizontal position and perform several repetitions to flex and strengthen the back and abdominal muscles.

Figure 4:
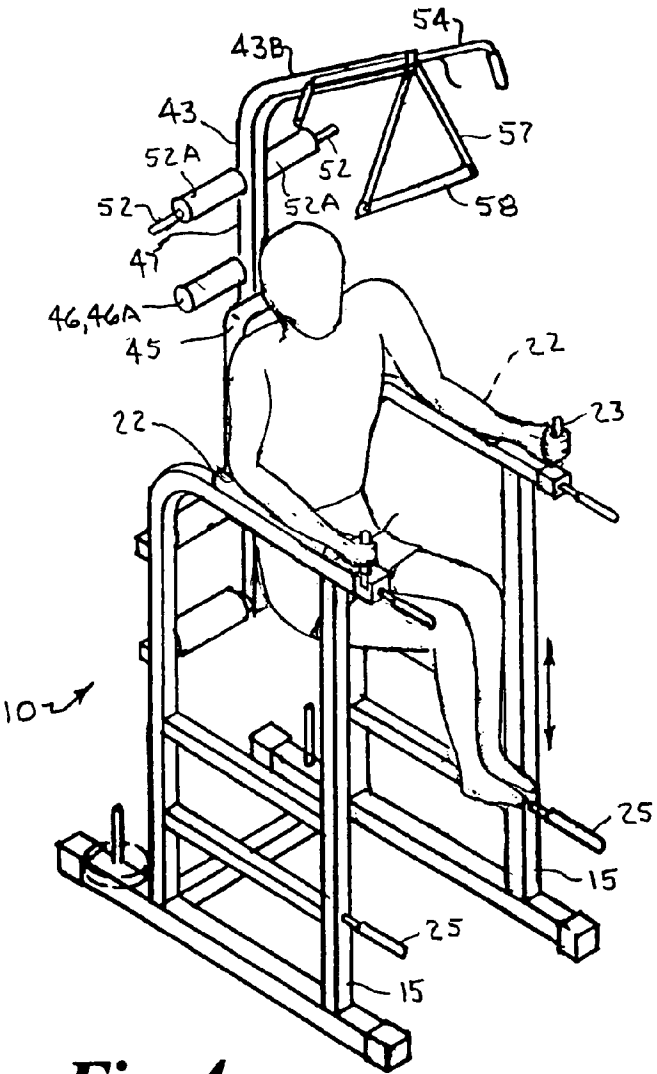
FIG. 4 is a perspective view showing, somewhat schematically, the roller removed and a user performing a vertical knee raise exercise.

As shown in FIG. 4 when the rotatable cylindrical roller 34 is removed from the station 10, the user can use the station as a vertical knee raise (VKR) station. The backrest 45, forearm pads 22 and vertical handgrips 23 are used when performing vertical knee raises, leg raises and oblique twists. The upper horizontal handgrips 52 may be gripped to perform dips, and the pull-up bar 54 at the outer end of the upper leg 43B of the central upright member 43 is used to perform chin-up and pull-up exercises. The lower horizontal handgrips 25 at the front of the station 10 may be used to perform pushups or squats with the roller 34 installed or removed.

Figure 5:
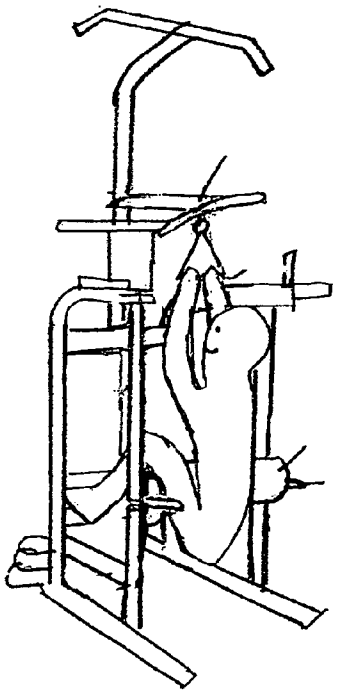
FIG. 5 is a perspective view showing, somewhat schematically, the roller mounted on the vertically adjustable handgrips and a user gripping an elastic cord to perform exercises.

FIG. 5 shows, somewhat schematically, a person using the station 10 with the cylindrical roller 34 mounted on the vertically adjustable handgrips 28 set at a desired height on the front upright members 15, and the pivot arm 47 in a lowered position with the elastic cord 37 with the handle bar 38 attached to the eyebolt 51 or ring of the pivot arm 47. The user is shown gripping the handle bar 38 with both hands and his or her feet hooked under the horizontal foot support rods 32 of the vertical leg 13A of the rear upright members 13 while rolling his or her back on body roller 34 performing back massage and stretch exercises.

Figure 6:
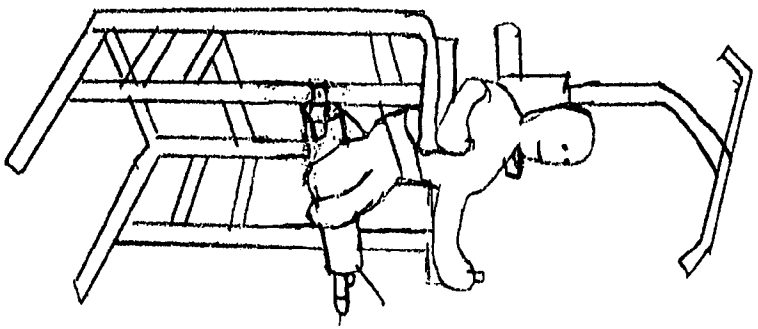
FIG. 6 is a perspective view showing, somewhat schematically, the roller mounted on the vertically adjustable handgrips and a user bending their knees over the roller.

FIG. 6 shows, somewhat schematically, a person using the station 10 with the cylindrical roller 34 mounted on the vertically adjustable handgrips 28 with his or her knees bending over the roller to stretch the leg quadriceps.

Figure 7:
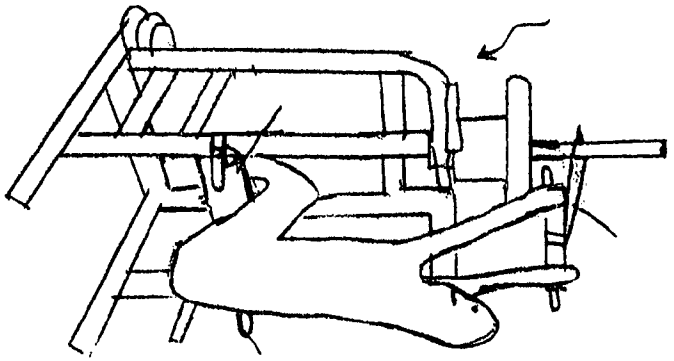
FIG. 7 is a perspective view showing, somewhat schematically, the roller mounted on the vertically adjustable handgrips and a user performing a stretching exercise.

FIG. 7 shows, somewhat schematically, a person using the station 10 with the cylindrical roller 34 mounted on the vertically adjustable handgrips 28 and the pivot arm 47 in a lowered position with the user gripping the handgrip portion at the ends of the 52 with both hands while hanging his or her lower back and body down and their legs over the roller 34 to perform a stretching exercise.

Figure 8:
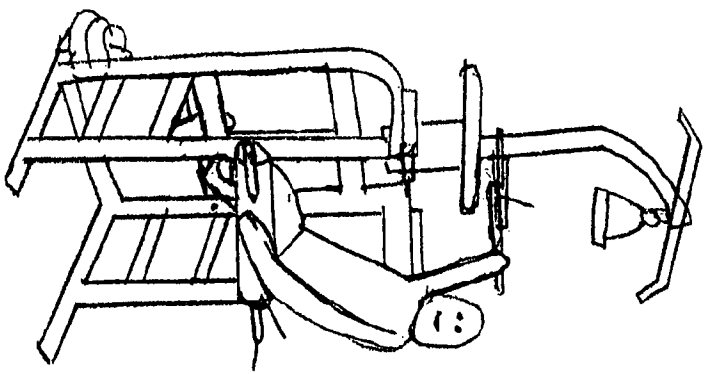
FIG. 8 is a perspective view showing, somewhat schematically, the roller mounted on the vertically adjustable handgrips and a user performing a back twist exercise.

FIG. 8 shows, somewhat schematically, a person using the station 10 with the cylindrical roller 34 mounted on the vertically adjustable handgrips 28 and the pivot arm 47 in a lowered position with the user sitting on the roller and gripping the handgrip portion at one end of the bar 52 with one hand twisting their upper body to one side in a back twisting and body stretching exercise.

Figure 9:
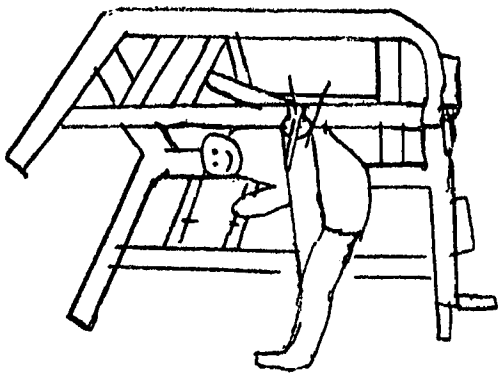
FIG. 9 is a perspective view showing, somewhat schematically, the roller mounted on the vertically adjustable handgrips and a user performing a partially inverted exercise.

FIG. 9 shows, somewhat schematically, a person using the station 10 with the cylindrical roller 34 mounted on the vertically adjustable handgrips 28 and the central upright member 43 removed from the I-shaped frame 37, with the user draped over the roller with their upper body and head positioned downwardly and their legs extended outwardly and gripping the upper cross members 16 at the sides of the station with both hands to perform a partially inverted balancing exercise.

Figure 10:
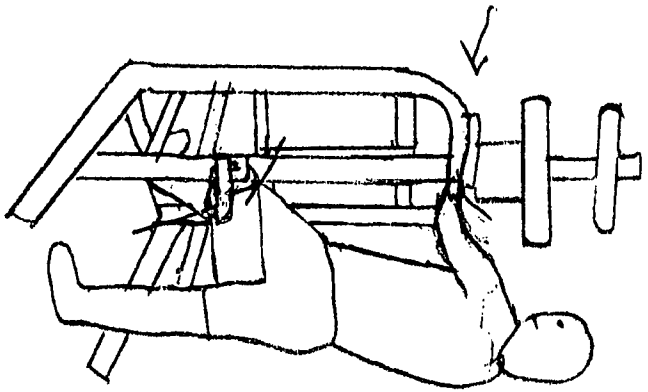
FIG. 10 is a perspective view showing, somewhat schematically, the roller mounted on the vertically adjustable handgrips and a user performing a leg and thigh massaging and stretching exercise.

FIG. 10 shows, somewhat schematically, the station 10 having a modified shorter central upright member 43C that does not have an outwardly extending upper portion. A person is shown using the station 10 with the cylindrical roller 34 mounted on the vertically adjustable handgrips 28 and the user gripping the upper horizontal handgrips 24 with one leg draped over the roller performing a leg and inner thigh massaging and stretching exercise.

Figure 11:
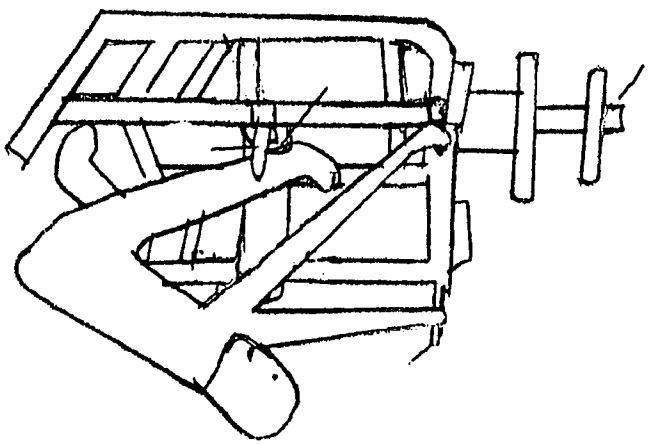
FIG. 11 is a perspective view showing, somewhat schematically, the station having a shorter central upright member and the roller mounted on the vertically adjustable handgrips and a user performing a leg stretching exercise.

FIG. 11 shows, somewhat schematically, the station 10 having the shorter central upright member 43C and the cylindrical roller 34 mounted on the vertically adjustable handgrips 28 and a user in a sitting position gripping the upper horizontal handgrips 24 with both hands and one leg extending upwardly and supported on the roller performing a leg stretching exercise.

Figure 12:
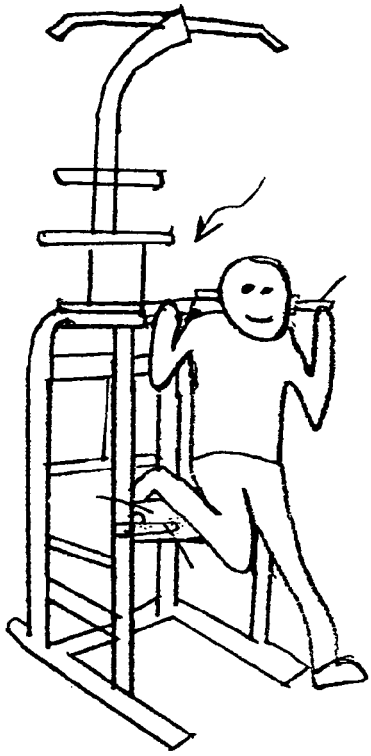
FIG. 12 is a perspective view showing, somewhat schematically, the roller removed and a user performing a leg quadricep stretch exercise.

FIG. 12 shows, somewhat schematically, the cylindrical roller 34 mounted on the vertically adjustable handgrips 28 and a user in standing position gripping the upper horizontal handgrips 24 with both hands and one leg bending rearwardly supported on the roller performing a leg stretching and massage exercise.

Figure 13:
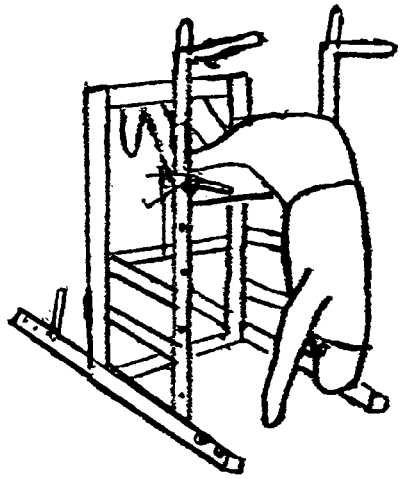
FIG. 13 is a perspective view showing, somewhat schematically, the station with the central upright member removed and a user performing an inversion exercise.

FIG. 13 shows, somewhat schematically, a person using the station 10 with the central upright member 43 and the top horizontal legs 13B of the of the rear upright members 13 removed, and the cylindrical roller 34 mounted on the vertically adjustable handgrips 28. The user is shown draped over the roller with their upper body and head positioned downwardly and their legs extended rearwardly and their heels hooked under the upper padded member 40 of the I-shaped frame 27 at the rear of the station such that they can raise and lower their upper body between the inverted position and a horizontal position and perform several repetitions to flex and strengthen the back and abdominal muscles.

Figure 14:
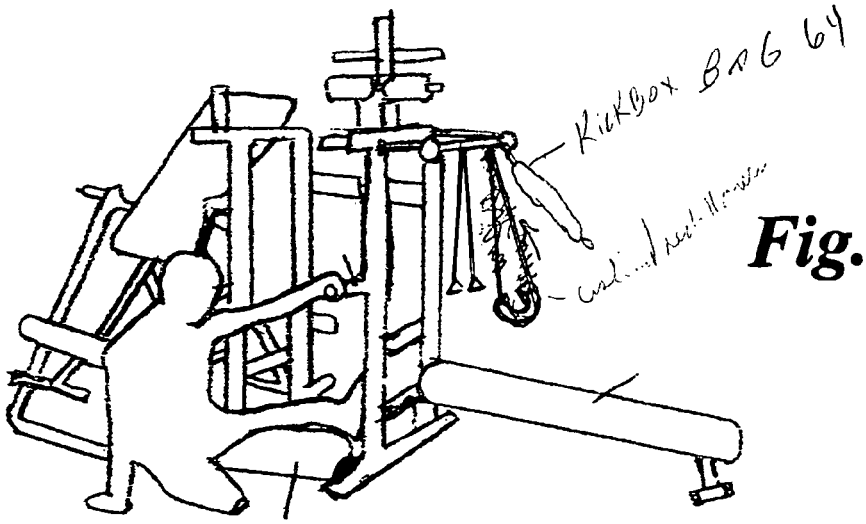
FIG. 14 is a perspective view showing, somewhat schematically, the station having a shorter central upright member, and the roller supported at a lower position, an inversion on one side and a bench folded out on the opposed side.

FIG. 14 shows, somewhat schematically, the station 10 having the shorter central upright member 43C and the cylindrical roller 34 mounted on the base member 11. A user is shown in a sitting position gripping one of the vertically adjustable handgrips 28 with one hand and one leg extending over the roller performing a leg stretching exercise. An inversion table T is shown attached on side of the station and a bench 93 (described hereinafter) supported at the other side. A bungee cord 62 having handles 62A at each end is connected to the storage rack 33. A C-shaped vibrating metal weighted neck cushion 63, barbell B, and a kick boxing member 64 are also shown connected to the storage rack 33. More than one person can use station at same time.

Figure 15:
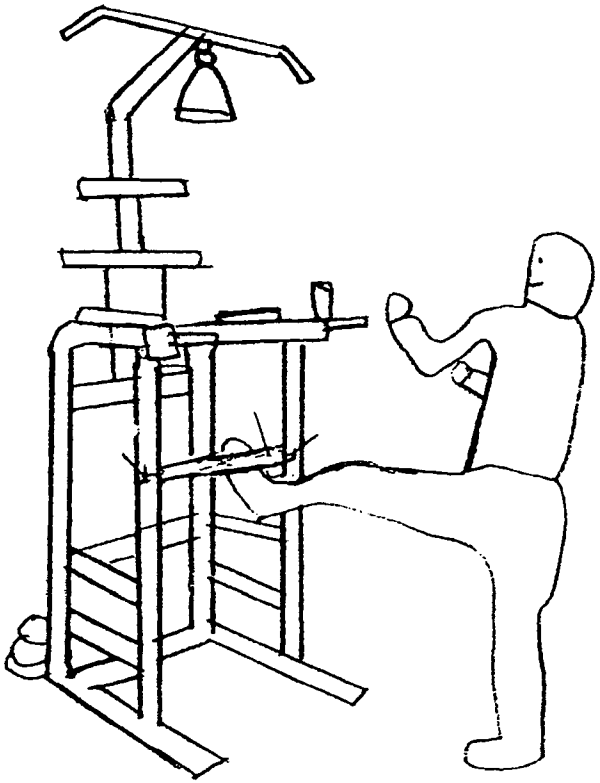
FIG. 15 is a perspective view showing, somewhat schematically, a bungee kick boxing member attached to the station and being used to perform kick boxing exercises.

FIG. 15 shows, somewhat schematically, a person using the station 10 with a bungee kick boxing member 64 having a horizontal flexible tubular member 64A with an elastic band 64B extending therethrough with opposed ends removably attached to a pair of the upper L-shaped rods 27 on the front side of the front upright members 15. When not in use, the bungee kick boxing member 64 may be hung from the storage rack 33.

Figure 16:
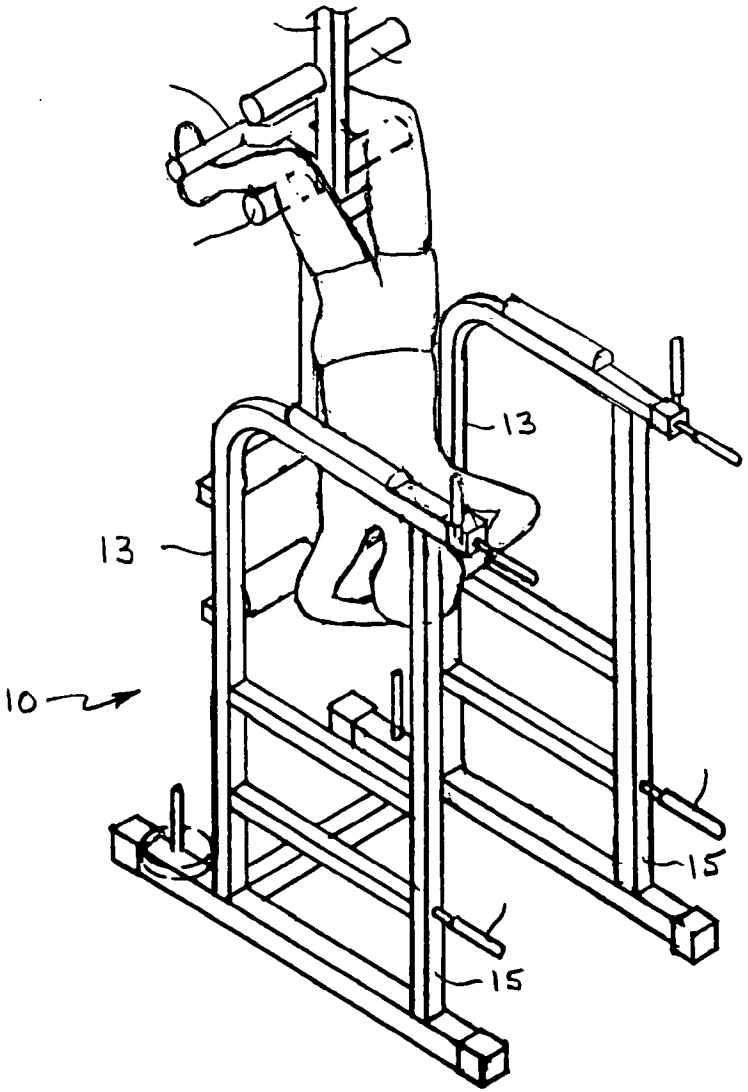
FIG. 16 is a perspective view showing, somewhat schematically, a user using the T-shaped foot support member in an inversion exercise.

As shown somewhat schematically in FIG. 16, when the T-shaped foot support member 60 is installed on the back side of the of the vertical leg 43A in an elevated position, the user may place the top portion of their feet under the lateral tubular members 60B and the back of their knees over the lower padded tubular members 46 and assume an inverted position such that their body will be supported with their head below their feet.

Figure 17:
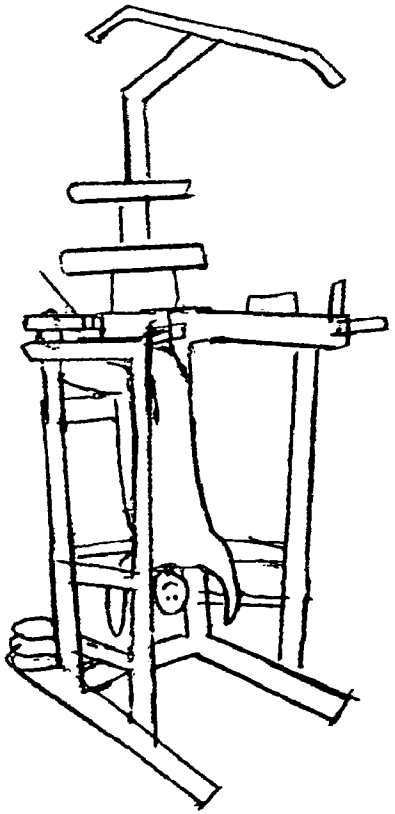
FIG. 17 is a perspective view showing, somewhat schematically, a user using the T-shaped foot support member connected to the exercise station at lower level for performing inversion exercises.

As shown somewhat schematically in FIG. 17, when the T-shaped foot support member 60 is installed on the back side of the of the vertical leg 43A in a lower position, the user may place the top portion of their feet under the lateral tubular members 60B and the back of their knees over the upper padded cross members 40 of the I-shaped frame 37 and assume an inverted position such that their body will be supported with their head below their feet.

Figure 18:
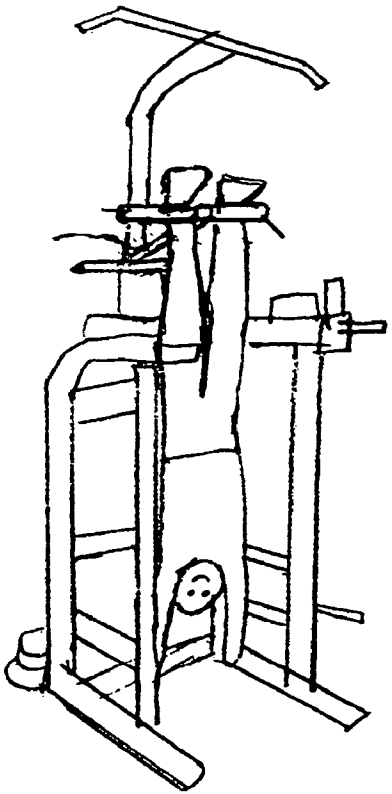
FIG. 18 is a perspective view showing, somewhat schematically, a user using the ankle supports on the T-shaped foot support member in an inversion exercise.

As shown somewhat schematically in FIG. 18, the user may hook the top portion of their feet under the pair of ankle supports 53 at the upper end of the pivot arm 43 and assume an inverted position such that their body will be supported with their head below their feet.

Figure 19:
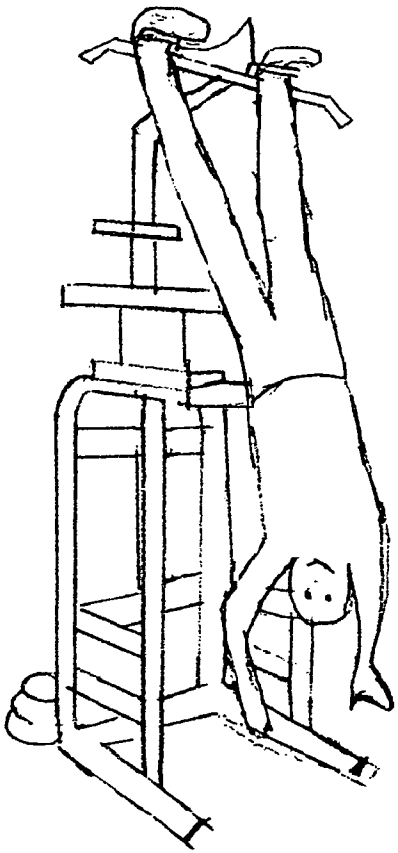
FIG. 19 is a perspective view showing, somewhat schematically, a user using the ankle supports on the pull-up bar in an inversion exercise.

As shown somewhat schematically in FIG. 19, the user may hook the top portion of their feet under the upper pair of ankle supports 56 at the lateral sides of the pull-up bar 54 at the upper leg 43B of the central upright member 43 and assume an inverted position such that their body will be supported with their head below their feet.

Various accessory exercise apparatus may be connected to the station 10 for performing a wide variety of additional exercises.

Figure 21:
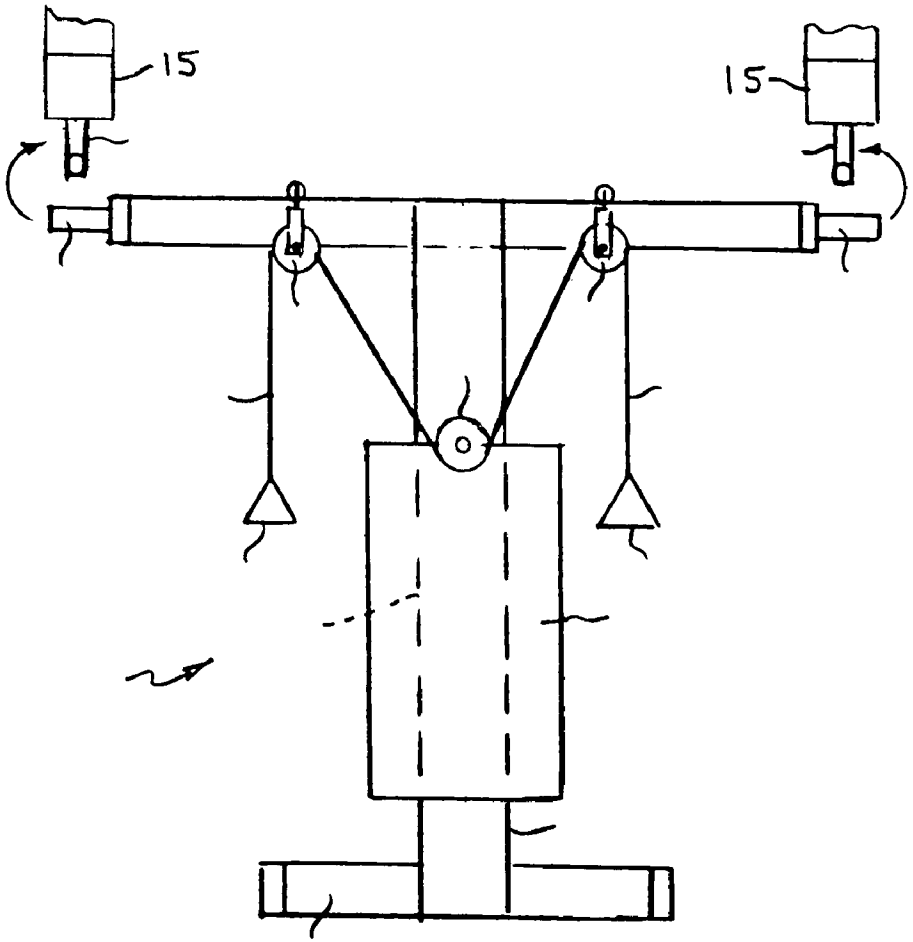
FIGS. 20 and 21 are a side elevation view and a top plan view, respectively, showing somewhat schematically, an inclined plane carriage apparatus connected to the exercise station.
Figure 20:
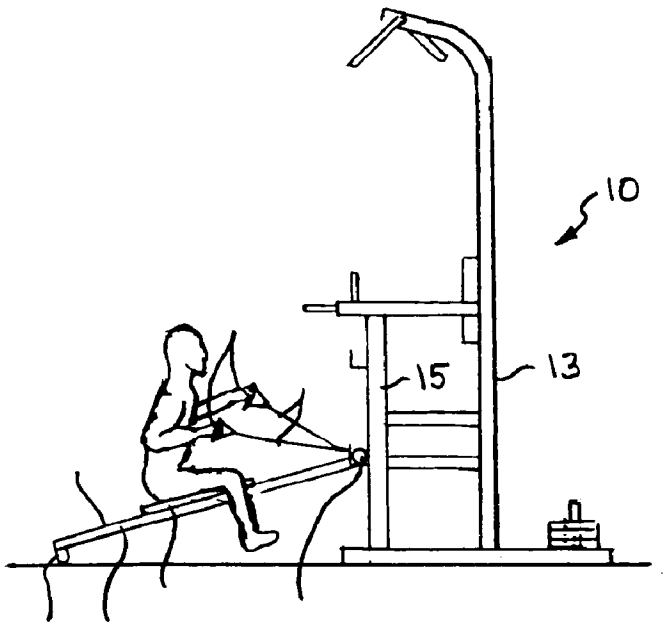

FIGS. 20 and 21 are a side elevation and a top plan view, respectively, showing somewhat schematically, an inclined plane carriage apparatus 66 connected with the exercise station 10. The inclined plane carriage apparatus 66 has a rectangular platform 67 with a transverse bar 68 at one end which is supported on the floor and a transverse bar 69 at the opposed end which is supported at each end in the lower U-shaped support surfaces 26 on the front lateral upright members 15. A pair of pulleys 70 are mounted on the bar 69 a distance outwardly from the opposed sides of the platform 66. A mobile carriage 71 is mounted for reciprocal movement on a pair of spaced tracks 72 on the platform and has a pulley 73 at its forward end. An elongate cable 74 having handles 75 at each end is entrained around the three pulleys. A user may sit or lie on the carriage and undergo core muscle training by pulling on the ends of the cable to move the carriage and his or her body supported thereon against the force of gravity. The platform track and carriage roller elements are conventional in the art, and therefore not shown in detail. When not in use, the inclined plane carriage apparatus 66 may be stored on the utility storage rack 33 on the outer facing side of the station 10.

Figure 22:
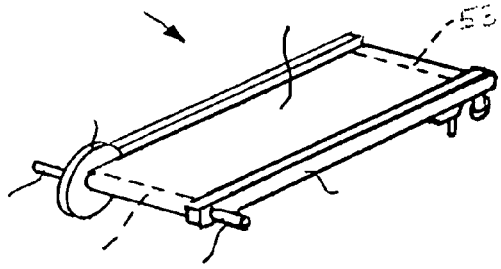
FIGS. 22 and 23 are an isometric view and a side elevation view, respectively, showing, somewhat schematically, a treadmill apparatus connected to the exercise station.
Figure 23:
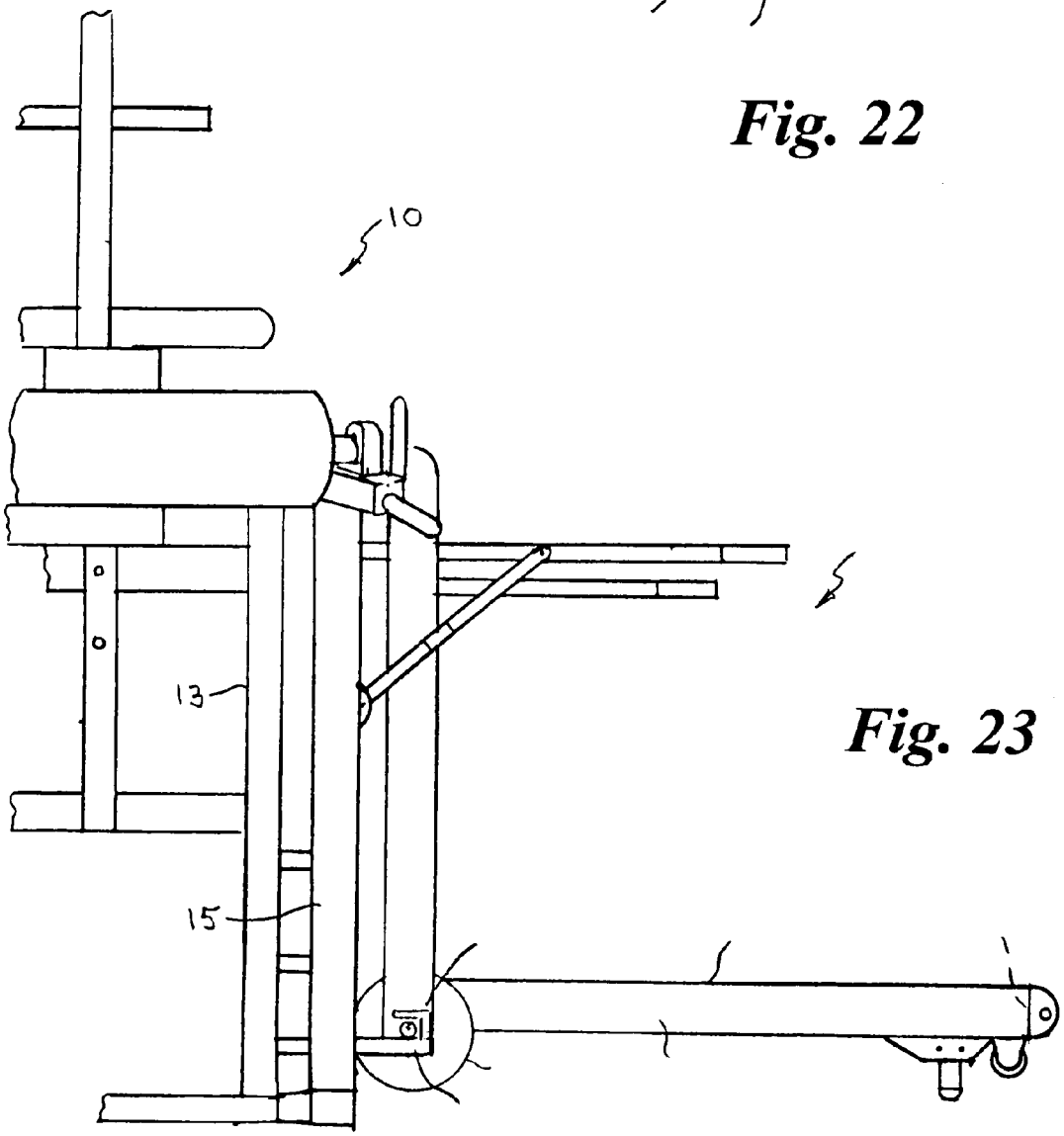

As shown somewhat schematically in FIGS. 22 and 23, a treadmill apparatus 76 may be connected to the side of the exercise station 10. The treadmill 76 has a rectangular frame 77 which is supported on the floor at one end and has a round bar 78 extending outwardly from laterally opposed sides at the opposite end which are supported in the lower J-shaped support surfaces 30 on the front and rear lateral upright members 13 and 15. A pair of rollers 79 are rotatably mounted one at each end of the frame 77, and an endless belt 80 is encircled around the rollers. The treadmill 76 is provided with a conventional flywheel 81 and resistance adjustment mechanisms, and may also be provided with additional mechanisms, such as digital displays, etc., which are conventional in the art and therefore not shown.

Figure 24:
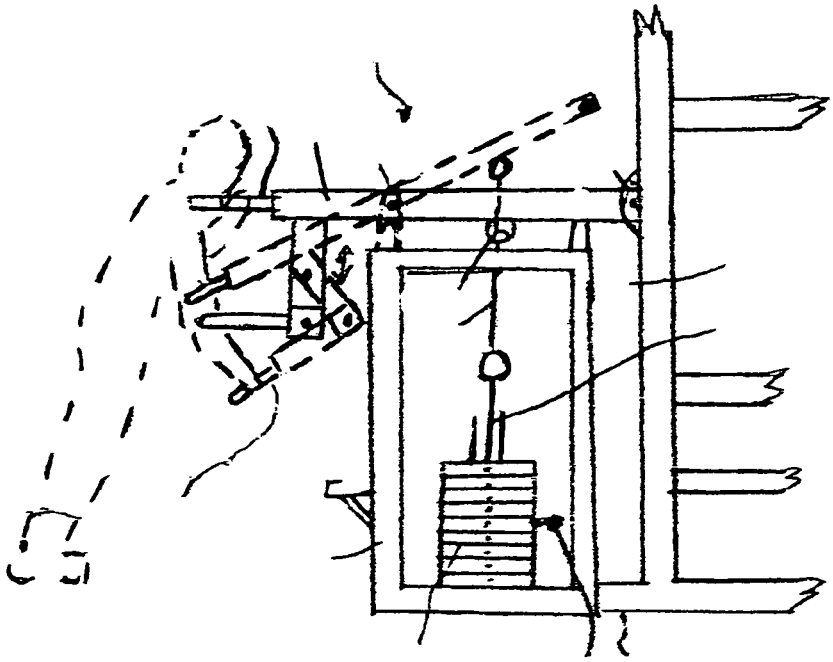
FIG. 24 is a side elevation view showing, somewhat schematically, a lever-type weight stack apparatus connected to the exercise station.
Figure 24A:
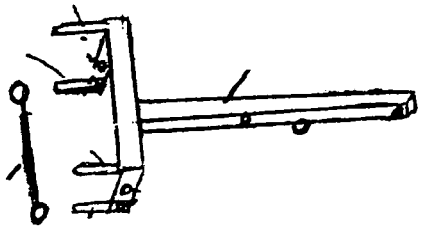

FIG. 24 is a side elevation showing somewhat schematically, a pivoting lever weight stack apparatus 82 connected to the exercise station 10, and FIG. 24A is a perspective view of the pivot lever arm 85 with a connector bar handgrip attachment 92. The weight stack apparatus 82 has a generally rectangular open frame 83 which is supported on the floor at the back of the station 10 and has a pair of laterally spaced tubular extensions 84 extending outwardly from a bottom end that are connected to the rear upright members 13. A lever arm 85 is pivotally connected at one end to a bracket 86 mounted at the upper end of a respective rear upright member 13 and extends outwardly above the weight frame 83. The outer end of the lever arm 85 is provided with an upper and lower pair of tubular extensions with handgrips 87A, 87B. A stack of weights W are movably supported for vertical movement in the frame 83, and a link member 88 extends through the weights. An elongate cable 89 is connected at its lower end to the link member 88 and to the lever arm 85 at its upper end. The cable 89 passes over a pulley 90 at the upper end of the frame 83. The weight stack is provided with a latch pin 91 that engages or releases a selected number of weights to adjust the amount of weight being lifted. The interior latching mechanism is well known in the art and therefore not shown. The weights may be lifted by the user pulling upwardly on the upper or lower pair of handgrips 87A, 87B. The lever arm 85 may also be disconnected from the bracket 86 and be pivotally connected near its midsection to a bracket 86A (shown in dashed line) mounted on the frame 83 near its outer end, wherein the weights are lifted by the user pushing downwardly on the upper or lower pair of handgrips 87, 87. As shown in FIG. 24A, a connector bar handgrip attachment 92 may be installed horizontally on either of the upper or lower pair of tubular handgrips to provide an alternate gripping surface for moving the lever bar up or down. The handgrips 87A, 87B may be removed or left in place on the extensions when the connector bar handgrip attachment 92 is installed.

Figure 25:
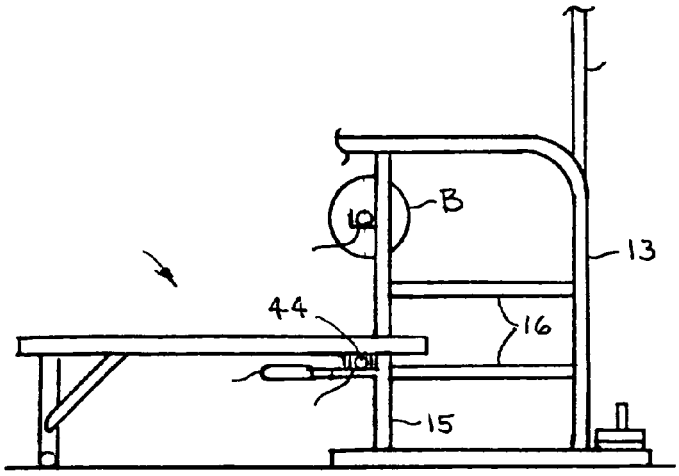
FIGS. 25 and 26 are a side elevation and a perspective view, respectively, showing somewhat schematically, a bench attached to the station and being used as a weight lifting bench.
Figure 26:
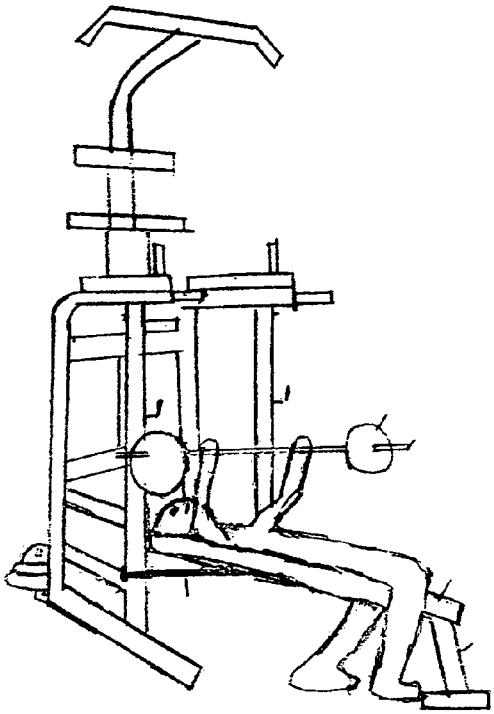

As shown somewhat schematically in FIG. 25 and in FIG. 26, a generally rectangular bench 93 may be releasably connected to the exercise station 10. This is accomplished by placing a horizontal bar 94 into the lower U-shaped support surfaces 26 on the front upright members 15 to extend transversely therebetween. The bench 93 is provided with an inverted U-shaped channel 95 on its underside near its front end that is removably supported on the bar 94. The bench 93 is provided with a folding leg 96 near its rear end. The bench 93, with the leg 96 extended may be used as a weight bench for bench press exercises, and the upper U-shaped support surfaces 27 on the front upright members 15 may be used to support a barbell B.

The bench 93 may also be connected to the side of the exercise station 10 by placing the horizontal bar 94 into the lower J-shaped support surfaces 30 on sides of the front upright member 15 and vertical leg 13A of the rear upright member 13. A bungee cord 62 having handles 62A at each end may be connected to the storage rack 33, or to either of the upper U-shaped support surfaces 31, whereby a user sitting or laying on the bench can perform exercises.

Figure 27:
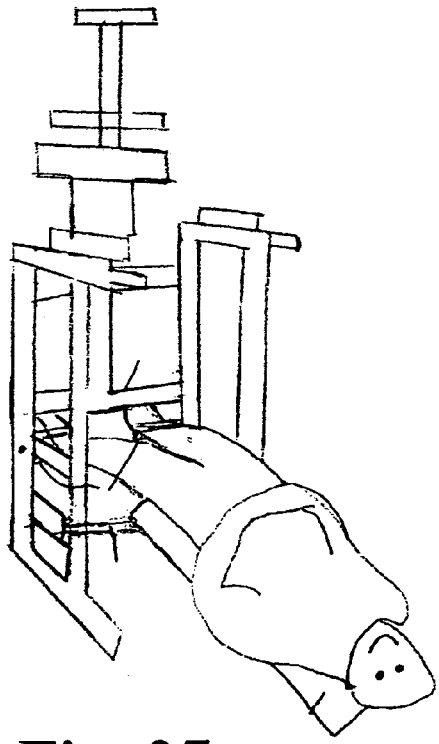
FIG. 27 is a perspective view showing, somewhat schematically, the bench attached to the station and being used as an inclined bench in performing exercises.

As shown somewhat schematically in FIG. 27, the bench 93, with the leg 96 folded, may be supported at an angle for use as an inclined bench, wherein the feet of the user can be hooked under the foot rests 32 at the rear of the station for doing sit-ups.

When not in use, the bench 93 may be stored on the utility storage rack 33 on the outer facing side of the station 10 and the horizontal bar 94 stored on the lower J-shaped support surfaces 30 on sides of the front upright member 15 and vertical leg 13A of the rear upright member 13.

Figure 28:
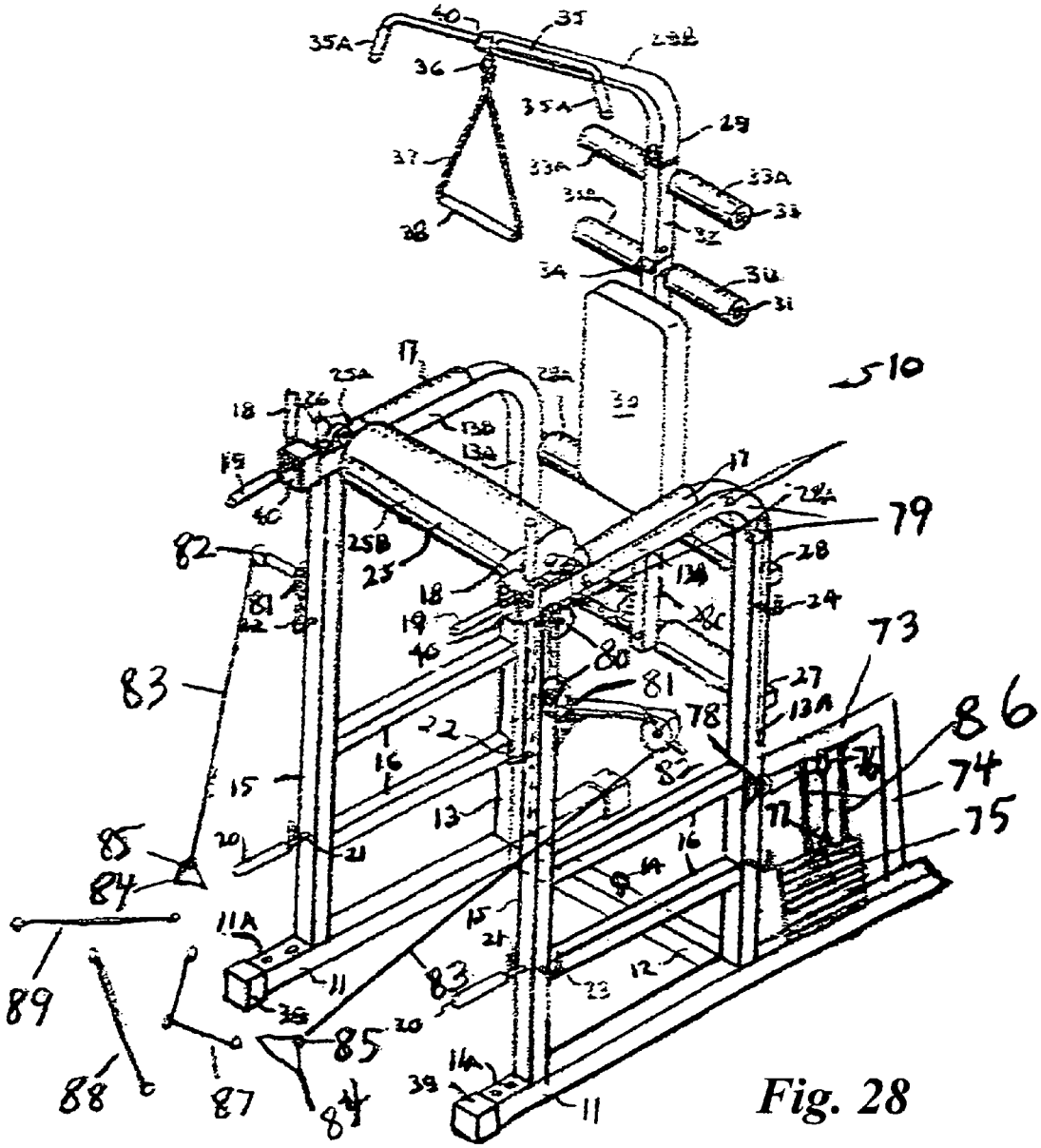
FIG. 28 is a perspective view showing, somewhat schematically, an alternate embodiment of the exercise station having a weight stack and adjustable arm pulley arm system.

FIG. 28 shows an alternate embodiment of the exercise station 10A having a weight stack and pulley mechanism. The components previously shown and described are assigned the same numerals of reference, but will not be described again in detail to avoid repetition. In this embodiment, the station includes a pair of weight frames 97 at the rear of the station, each having a horizontal tubular member 97A extending rearwardly from the vertical leg 13A of each rear upright member 13 and a vertical tubular member 97B extending between the horizontal member and the rear portion 11B of the base member 11. A stack of weights W are movably supported for vertical movement in each frame 97, and an attachment rod 98 and a pair of guide rods 99 extend through the weights. The weight stack is provided with a latch pin mechanism that engages or releases a selected number of weights to adjust the amount of weight being lifted. The details of the latching mechanism are well known in the art and therefore not shown.

An arcuate bracket 100 with a plurality of holes for receiving a latch pin is secured to each front upright member 15 near its upper end and an adjustment arm 101 is connected at one end to a respective bracket to extend laterally outward from the front upright members 15 at selected angles. Installing a latch pin in a selected hole in the bracket 100 controls the angle of the adjustment arm 101. A pulley 102 is rotatably mounted at the outer end of each adjustment arm 101. A pair of pulleys 103 are rotatably mounted on each front upright member 15 in vertically spaced relation, a pulley 104 is rotatably mounted on the horizontal leg 13B of each rear upright member 13, a pulley 105 is rotatably mounted on the vertical leg 13A of each rear upright member, and a pulley 106 is rotatably mounted on the horizontal tubular member 97A of the weight frame 97. An elongate cable 107 is connected at one end to the attachment rod 98 of each respective weight set and has a handle 108 attached to its free end. The cable 107 passes over the pulleys 106, 105, 104, 103 and 102.

The handles 108 may be releasably attached to the cables 107 by an attachment ring 109 at their free ends. Alternatively, the handles 108 may be removed and a rigid generally V-shaped three-ring attachment bar 110 attached at its outer ends to the attachment rings 109 at the free ends of the cables and a single handle 108 reinstalled at the center of the V-shaped attachment bar. In another variation, the handles 108 may be removed and either a rigid short straight bar 111 or a longer straight bar 112 attached at its outer ends to the attachment rings 109 at the free ends of the cables.

Figure 29:
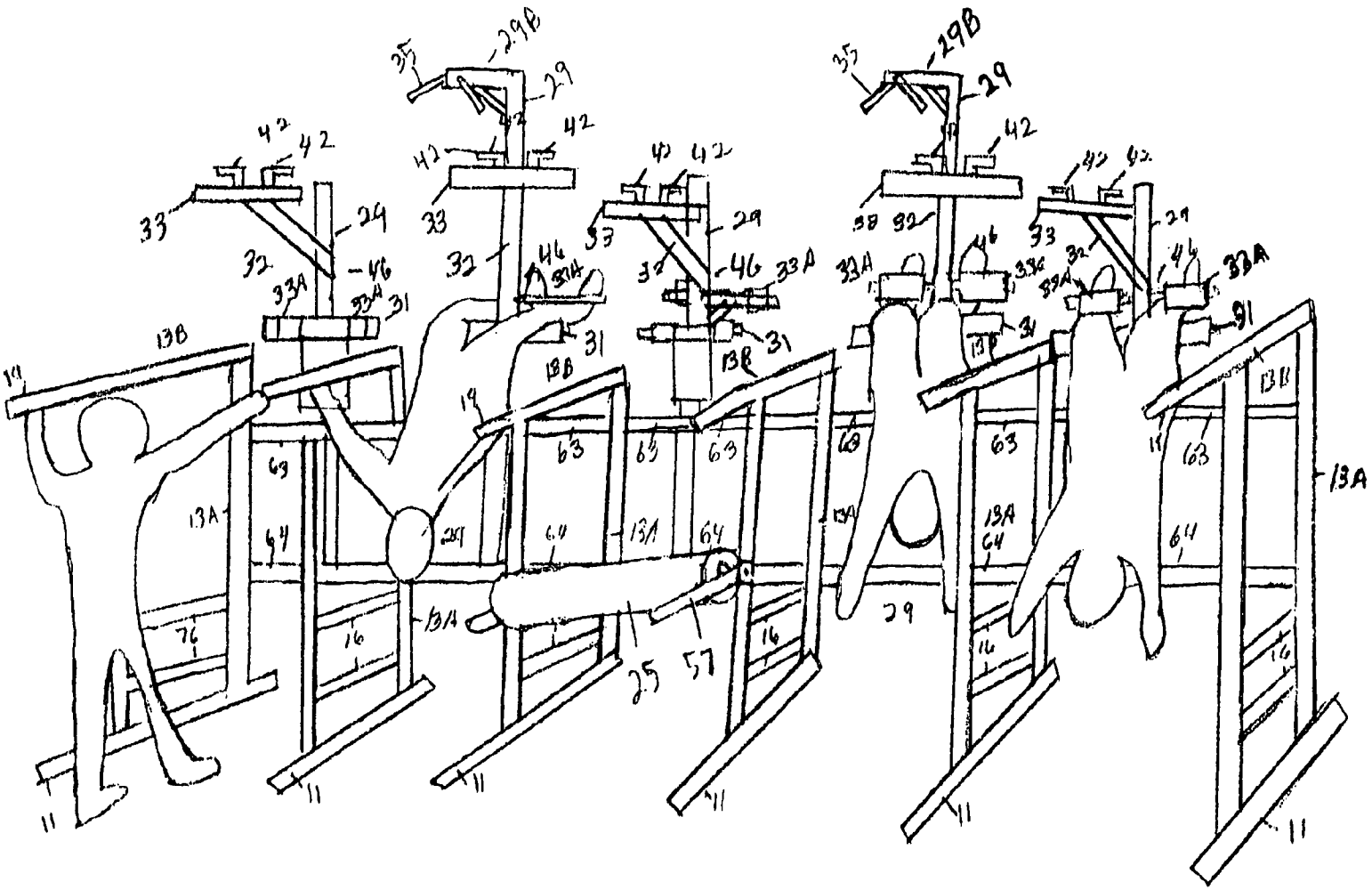
FIG. 29 is a perspective view showing, somewhat schematically, a plurality of the stations disposed in side-by-side relation accommodate multiple users at same time.

As shown somewhat schematically in FIG. 29, a plurality of the stations 10 may be positioned or connected side-by-side whereby several persons may use the stations at the same time. The stations 10 are shown with the various attachments installed or removed and some equipped with the longer central upright member 43 and some with the shorter central upright member 43C which does not have an outwardly extending upper portion, as described previously. The components previously shown and described are assigned the same numerals of reference, but will not be described again in detail to avoid repetition.

Figure 30:
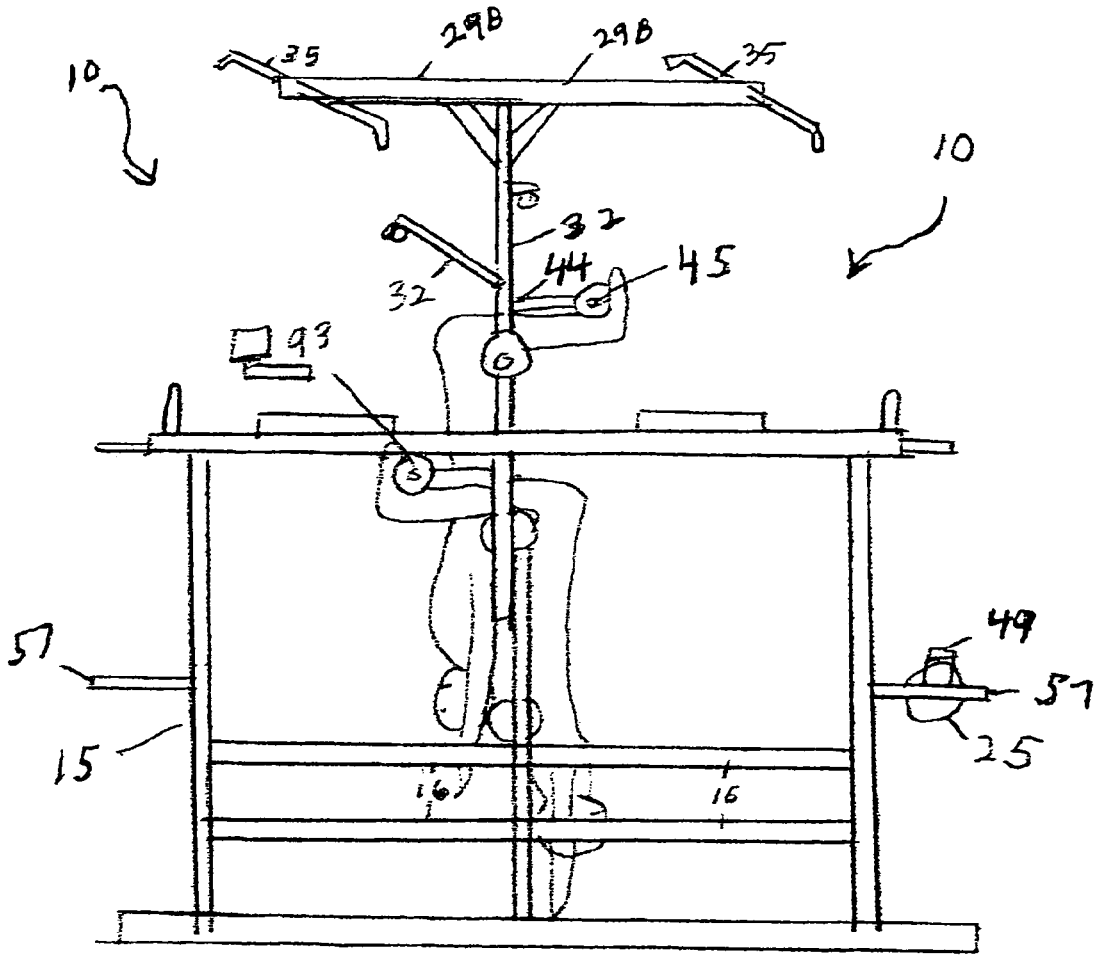
FIG. 30 is a side view showing schematically, a modification of the station having a back-to-back arrangement that allows two persons to perform inversion exercises at the same time.

FIG. 30 is a side view showing schematically, a modification of the station 10B that is somewhat similar to two of the previously described stations 10 disposed back-to-back that allows two persons to perform inversion exercises at the same time. The components previously shown and described are assigned the same numerals of reference, but will not be described again in detail to avoid repetition. In this modification, the station 10B has a central upright member 43 with an upper portion having a pair of shorter upper legs 43D that extend outwardly therefrom in opposed relation. The frame also has a single rear upright member 13 with a pair of base members 11D that extend outwardly therefrom in opposed relation and a front upright member 15 near each outer end thereof. A pair of top horizontal legs 13B extend outwardly from each vertical leg 13A of the rear upright member 13 in opposed relation and adjoin the front vertical upright members 15, and a pair of parallel horizontal cross members 16 extend between each vertical leg 13A and the front vertical upright members 15 in opposed relation. The frame is also provided with a pair of inward facing generally L-shaped padded inversion foot hooks 114 on each side of the frame near one pair of the horizontal legs 13B to accommodate the feet of one of the users.

Figure 31:
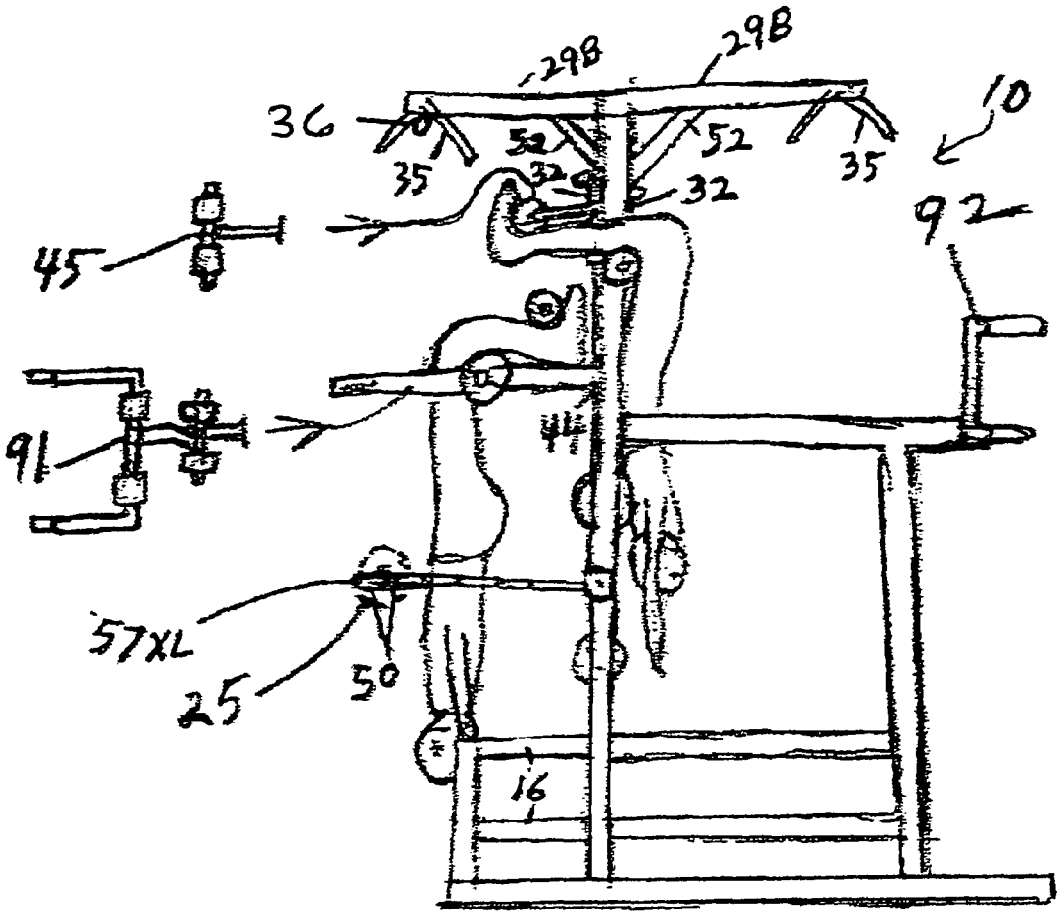
FIG. 31 is a side view showing schematically, another modification of the station that allows two persons to perform inversion exercises at the same time.

FIG. 31 is a side view showing schematically, another modification of the station 10C that is somewhat similar to the one described previously that allows two persons to perform inversion exercises at the same time. The components previously shown and described are assigned the same numerals of reference, but will not be described again in detail to avoid repetition. In this modification, the station 10C has a central upright member 43 with an upper portion having a pair of shorter upper legs 43D that extend outwardly therefrom in opposed relation. The frame also has a single rear upright member 13 with a pair of base members 11D that extend outwardly therefrom in opposed relation and a longer front upright member 15 near one end and a shorter front upright member 15A at the opposed ends thereof. A pair of top horizontal legs 13B extend outwardly from each vertical leg 13A of the rear upright member 13 and adjoin the longer front vertical upright members 15, and a pair of parallel horizontal cross members 16 extend between each vertical leg 13A and the front vertical upright members 15 and 15A in opposed relation. The T-shaped foot support member 60 is shown attached to the pivot arm 47 and a second foot support member 115 is attached to the central vertical member 43 therebelow. The second foot support member 115 has a central tubular portion 115A with a flat flange 115B at one end and a U-shaped tubular member 115C with pads 115D on the lateral portions and handgrips 115E on the outwardly extending legs. A T-shaped member 116 having a central tubular portion 116A is secured at one end to the central tubular portion 115A of foot support 115 and has a pair of laterally extending padded tubular members 116B at the opposed end. The flange 115B of the foot support 115 is installed in a slotted bracket 61 attached to the vertical leg 43A, as previously shown and described in FIG. 1A with reference to the T-shaped foot support member 60. In this modification, the vertically adjustable handgrips 28 with mounting holes 17 are elongated and a roller 34 may be installed thereon. An upper dip handle 117 is attached via the mounting holes 17 to the upper horizontal handgrip 24 to accommodate taller users.

The station can also be made without the tubular horizontal cross members 16 to allow more room for using a punching bag attached to the eyebolt 55.

While this invention has been described fully and completely with special emphasis upon preferred embodiments, it should be understood that within the scope of the appended claims the invention may be practiced otherwise than as specifically described herein.

The invention claimed is:

1. A freestanding back therapy and multiple exercise station on which performance of various therapeutic, stretching, bending, twisting, extension and inversion exercises may be carried out for flexing and decompressing the spine and strengthening the muscles of the body of a user, comprising:

a frame of tubular construction having a pair of generally rectangular laterally spaced sides, each of said sides formed of a straight elongate horizontal tubular base member having front and rear ends, a front vertical tubular member and a rear vertical tubular member each secured at a bottom end to said base member intermediate its ends and extending upwardly therefrom in parallel spaced relation;

a pair of lower horizontal handgrips each extending outwardly from a front side of each said front vertical tubular member a distance above a respective said base member to be gripped by a user when performing exercises and each having a support surface adjacent to said front vertical tubular member for receiving and supporting objects thereon;

a pair of horizontal vertically adjustable handgrips, each having a U-shaped portion that straddles a respective said front vertical tubular member and is releasably connected thereto at selected heights by a latch pin passed through holes in said U-shaped portion and said vertical tubular member, and each having a tubular extension extending outwardly therefrom for receiving and supporting objects thereon;

a first and a second pair of parallel vertically spaced padded tubular cross members connected at opposed ends with each said rear vertical tubular member and extending transversely therebetween to serve as lower foot supports for supporting a user when performing various exercises;

a central tubular upright member having an elongate vertical lower portion disposed centrally between said rear vertical tubular members connected at a lower end with said first and second padded tubular cross members and extending vertically upward therefrom parallel with said rear vertical tubular members, a backrest pad mounted on a front side of said vertical lower portion, and a third pair of padded tubular members above said backrest pad extending laterally outward from opposed sides of said vertical lower portion to selectively serve either as handgrips or as elevated leg or foot supports when performing exercises;

a pivot arm pivotally connected at a lower end to said central tubular member vertical lower portion above said backrest pad and having a top end releasably connected with said vertical lower portion, and a fourth pair of padded tubular members extending laterally outward from opposed sides of said pivot arm, said pivot arm being selectively positionable between a first position generally parallel with said vertical lower portion, wherein said fourth pair and said third pair of padded tubular members are aligned in substantially parallel vertically spaced relation to provide elevated foot support surfaces on which the user may place the instep of his or her feet to support or suspend their body when performing inversion exercises, and a second position extending angularly upward and forward from said vertical lower portion, wherein said fourth pair of padded tubular members are disposed near the center of said frame to serve as elevated handgrips to be gripped by the user when performing body lifting exercises; and foot supports on said laterally spaced sides of said frame on which the user may place their feet to assume positions on said station or when performing exercises.

2. The exercise station according to claim 1, further comprising:

a cylindrical cushioned roller rotatably mounted at opposed ends transversely between said front vertical tubular members at selected heights above said base members to serve as a back, leg, or abdomen engaging roller or a seating surface when performing exercises;

said cylindrical cushioned roller electively positioned relative to said first and second pair of parallel vertically spaced padded tubular cross members extending between said rear vertical tubular member and said third pair of padded tubular members above said backrest to allow the user to selectively engage their feet on either of said first and second pair of padded tubular cross members or on said third pair of padded tubular members and selectively support either of their lumbar area or abdomen on said roller such that their upper body will be in an inverted position with their head below their feet, or to support the leg or legs of the user in a seated or standing position when performing exercises.

3. The exercise station according to claim 1, further comprising:

a cylindrical cushioned roller rotatably mounted at opposed ends transversely between a front portion or rear portion of said base members to serve as a back, leg, or abdomen engaging roller or a seating surface when performing exercises;

said cylindrical cushioned roller electively positioned relative to said first and second pair of parallel vertically spaced padded tubular cross members extending between said rear vertical tubular member and said third pair of padded tubular members above said backrest to allow the user to selectively engage their feet on either of said first and second pair of padded tubular cross members or on said third pair of padded tubular members and selectively support either of their lumbar area or abdomen on said roller, or to support the leg or legs of the user in a seated or standing position when performing exercises.

4. The exercise station according to claim 1, further comprising:

a pair of tubular horizontal top members, each extending between upper ends of said front and rear vertical tubular members, respectively; and a cushioned forearm pad on each said horizontal top member, and an upper dual grip member having a vertical handgrip and a horizontal handgrip at an outer end of each said horizontal top member.

5. The exercise station according to claim 4, further comprising:

a cylindrical cushioned roller rotatably mounted at opposed ends transversely between said horizontal top members forward of said forearm pads to serve as a back, leg, or abdomen engaging roller or a seating surface when performing exercises;

said cylindrical cushioned roller positioned relative to said first and second pair of parallel vertically spaced padded tubular cross members extending between said rear vertical tubular member and said third pair of padded tubular members above said backrest to allow the user to selectively engage their feet on either of said first and second pair of padded tubular cross members or on said third pair of padded tubular members and selectively support either of their lumbar area or abdomen on said roller such that their upper body will be in an inverted position with their head below their feet.

6. The exercise station according to claim 4, further comprising:

a utility storage rack on an outer facing side of at least one said horizontal top member for receiving and storing various components and attachments when they are not in use.

7. The exercise station according to claim 1, wherein said central tubular upright member has a tubular upper portion above said backrest pad extending outwardly from its said vertical lower portion, and a pull-up bar at an outer end of said upper portion having opposed ends extending laterally outward from each side thereof to be gripped by the user when performing exercises.

8. The exercise station according to claim 7, further comprising:

a pair of laterally opposed ankle support members on said pull-up bar extending outwardly therefrom to provide ankle support surfaces under which the user may place the instep of his or her feet to support or suspend their body when performing inversion exercises.

9. The exercise station according to claim 1, further comprising:

a generally T-shaped foot support member having a central arm removably connected at one end with said central tubular upright member to extend outwardly therefrom and having padded tubular members extending laterally outward from an outer end thereof to provide elevated foot support surfaces under which the user may place the instep of his or her feet with the back of their knees supported over said third pair of padded members to support or suspend their body when performing inversion exercises.

10. The exercise station according to claim 1, further comprising:

a generally T-shaped foot support member having a central arm connected at one end with said pivot arm to extend outwardly therefrom and having padded tubular members extending laterally outward from an outer end thereof to provide elevated foot support surfaces under which the user may place the instep of his or her feet with the back of their knees supported over said third pair of padded members to support or suspend their body when performing inversion exercises.

11. The exercise station according to claim 1, further comprising:

a pair of laterally opposed ankle support members on said pivot arm extending outwardly therefrom to provide ankle support surfaces under which the user may place the instep of his or her feet to support or suspend their body when performing inversion exercises.

12. The exercise station according to claim 1, further comprising:

an elastic cord connected at one end with said pivot arm and having a handlebar at a free end to be gripped by a user for performing exercises.

13. The exercise station according to claim 1, wherein said first and second pair of parallel vertically spaced padded tubular cross members are adjustably connected at opposed ends with each said rear vertical tubular member to allow said pair of generally rectangular laterally spaced sides of said frame to be laterally positioned at selected distances apart.

14. The exercise station according to claim 1, further comprising:

a pair of weight stack frames, each disposed at a rear end of a respective one of said pair of generally rectangular laterally spaced sides of said frame adjacent to said rear vertical tubular members, a stack of weights movably supported for vertical movement in said weight stack frame, a link member extending through said weights, a series of pulleys rotatably mounted on each of said laterally spaced sides and a pulley at an upper end of said weight stack frame, and a pair of elongate cables, each connected at one end with a respective said link member and passing over said pulleys and having a hand gripping means the free ends thereof.

15. The exercise station according to claim 14, further comprising:

a bracket secured to each said front upright member near an upper end, and an adjustment arm pivotally connected at one end to a respective said bracket to extend laterally outward therefrom, a pulley rotatably mounted at the outer end of each said adjustment arm, and latch means engageable with each said adjustment arm for releasably latching said adjustment arm at selected angular positions; and each of said elongate cables additionally passing over said pulley at the outer end of a respective said adjustment arm.

16. The exercise station according to claim 1, further comprising:

a treadmill apparatus having a rectangular frame supported on a floor surface at one end and removably supported at the opposite end on said station frame;

a pair of rollers rotatably mounted one at each end of said treadmill frame: and an endless belt entrained around said rollers.

17. The exercise station according to claim 1, further comprising:

a bungee kick boxing member having a horizontal flexible tubular member with an elastic band extending therethrough with opposed ends removably connected with said front upright members to extend transversely therebetween.

18. The exercise station according to claim 1, further comprising:

a generally rectangular bench supported at one end on said frame and having a folding leg at an opposed end;

in a leg folded position, said bench supported in an inclined plane with said opposed end engaged on a floor surface, and in a leg unfolded position, supported in a horizontal plane with said leg engaged on the floor surface.

19. The exercise station according to claim 1, further comprising:

an inclined plane carriage apparatus having a generally rectangular platform supported on a floor surface at one end and removably supported at an opposed end on said frame;

a pair of pulleys disposed a distance outwardly from opposed sides of said platform;

a mobile carriage mounted for reciprocal movement on said platform and a pulley at its forward end;

an elongate cable having handles at each end entrained around said pulleys, whereby the user may sit or lie on said carriage and, by pulling on said cable, move said carriage and his or her body supported thereon against the force of gravity.

20. The exercise station according to claim 1, wherein a plurality of said stations are disposed in adjacent side-by-side relation to allow several persons to perform exercises thereon at the same time.

21. A freestanding back therapy and multiple exercise station on which performance of various therapeutic, stretching, bending, twisting, extension and inversion exercises may be carried out for flexing and decompressing the spine and strengthening the muscles of the body of a user, comprising:

a frame of tubular construction having a pair of generally rectangular laterally spaced sides, each of said sides formed of a straight elongate horizontal tubular base member having opposed outer ends, a pair of front vertical tubular members each secured at a bottom end to said base member near its said opposed outer ends and extending upwardly therefrom, a rear vertical tubular member secured at a bottom end to said base member intermediate said front vertical tubular member in parallel spaced relation thereto, a tubular horizontal top member extending between upper ends of said rear vertical tubular member and at least one of said front vertical tubular members, respectively, a cushioned forearm pad on said horizontal top member, and an upper dual grip member having a vertical handgrip and at least one horizontal handgrip at an outer end of said horizontal top member;

a pair of horizontal vertically adjustable handgrips, each having a U-shaped portion that straddles a respective said front vertical tubular member and is releasably connected thereto at selected heights by a latch pin passed through holes in said U-shaped portion and said vertical tubular member, and each having a tubular extension extending outwardly therefrom for receiving and supporting objects thereon;

a first and a second pair of parallel vertically spaced padded tubular cross members connected at opposed ends with each said rear vertical tubular member and extending transversely therebetween to serve as lower foot or leg supports for supporting a user when performing various exercises;

a central tubular upright member having an elongate vertical lower portion disposed centrally between said rear vertical tubular members connected at a lower end with said first and second padded tubular cross members and extending vertically upward therefrom parallel with said rear vertical tubular members, a backrest pad mounted on a front side of said vertical lower portion, a third pair of padded tubular members above said backrest pad extending laterally outward from opposed sides of said vertical lower portion to selectively serve either as handgrips or as elevated leg or foot supports when performing exercises, and a tubular upper portion above said backrest pad having outer ends extending outwardly from said vertical lower portion in opposed relation, and a pull-up bar at each of said outer ends having opposed ends extending laterally outward from each side thereof to be gripped by the user when performing exercises;

a pivot arm pivotally connected at a lower end to said central tubular member vertical lower portion above said backrest pad and having a top end releasably connected with said vertical lower portion, and a fourth pair of padded tubular members extending laterally outward from opposed sides of said pivot arm, said pivot arm being selectively positionable between a first position generally parallel with said vertical lower portion, wherein said fourth pair and said third pair of padded tubular members are aligned in substantially parallel vertically spaced relation to provide elevated foot support surfaces on which the user may place the instep of his or her feet to support or suspend their body when performing inversion exercises, and a second position extending angularly upward and forward from said vertical lower portion, wherein said fourth pair of padded tubular members are disposed near the center of said frame to serve as elevated handgrips to be gripped by the user when performing body lifting exercises;

a removable generally T-shaped foot support member having a central arm selectively connected at one end with either or both of said central tubular upright member or said pivot arm to extend outwardly therefrom and having padded tubular members extending laterally outward from an outer end thereof to provide elevated foot support surfaces under which the user may place the instep of his or her feet with the back of their knees supported over said third pair of padded members to support or suspend their body when performing inversion exercises; and foot supports on said laterally spaced sides on which the user may place their feet to assume positions on said station or when performing exercises.

* * * * *